US012636756B2

(12) United States Patent
Kavanaugh et al.

(10) Patent No.: US 12,636,756 B2
(45) **Date of Patent: *May 26, 2026**

(54) BINDER COMPOSITIONS OF TUNGSTEN TETRABORIDE AND ABRASIVE METHODS THEREOF

(71) Applicants: The Regents of the University of California, Oakland, CA (US); SuperMetalix, Inc., Los Angeles, CA (US)

(72) Inventors: Jack Kavanaugh, Los Angeles, CA (US); Richard B. Kaner, Pacific Palisades, CA (US); Chris Turner, Lancaster, CA (US); Georgiy Akopov, Greenwood, SC (US)

(73) Assignees: THE REGENTS OF THE UNIVERSITY OF CALIFORNIA, Oakland, CA (US); SUPERMETALIX. INC., Los Angeles, CA (US)

( * ) Notice: Subject to any disclaimer, the term of this patent is extended or adjusted under 35 U.S.C. 154(b) by 176 days.

This patent is subject to a terminal disclaimer.

(21) Appl. No.: 18/228,484

(22) Filed: Jul. 31, 2023

(65) Prior Publication Data

US 2023/0373064 A1 Nov. 23, 2023

Related U.S. Application Data

(63) Continuation of application No. 17/307,600, filed on May 4, 2021, now Pat. No. 11,752,593, which is a (Continued)

(51) Int. Cl.
*B24D 3/06* (2006.01)
*B22F 3/105* (2006.01)
(Continued)

(52) U.S. Cl.
CPC ..... *B24D 3/06* (2013.01); *B22F 3/105* (2013.01); *B24D 18/0009* (2013.01); *C22C 9/06* (2013.01);
(Continued)

(58) Field of Classification Search
None
See application file for complete search history.

(56) References Cited

U.S. PATENT DOCUMENTS 3,668,017 A 6/1972 Mandineau et al.
4,268,582 A 5/1981 Hale et al.
(Continued)

FOREIGN PATENT DOCUMENTS

EP 3408422 A1 12/2018
JP H05-005152 A 1/1993
(Continued)

OTHER PUBLICATIONS

Yang et al., "Effects of Sn addition on as-cast microstructure, mechanical properties and casting fluidity of ZA84 magnesium allow", Materials and Design, (Jul. 15, 2009), vol. 31, pp. 68-75.
(Continued)

*Primary Examiner* — Colin W. Slifka
(74) *Attorney, Agent, or Firm* — Venable LLP; Ryan T. Ward

(57) ABSTRACT

Disclosed herein, in certain embodiments, are composite materials, methods, tools and abrasive materials comprising a tungsten-based metal composition and an alloy. In some cases, the composite materials or material are resistant to oxidation.

20 Claims, 1 Drawing Sheet

Related U.S. Application Data continuation of application No. 15/415,553, filed on Jan. 25, 2017, now Pat. No. 11,033,998.

(60) Provisional application No. 62/286,865, filed on Jan. 25, 2016.

(51) Int. Cl.

| | |
|---|---|
| ***B22F 3/14*** | (2006.01) |
| ***B22F 3/15*** | (2006.01) |
| ***B22F 5/00*** | (2006.01) |
| ***B24D 18/00*** | (2006.01) |
| ***C22C 9/06*** | (2006.01) |
| ***C22C 29/14*** | (2006.01) |
| ***C22C 29/18*** | (2006.01) |
| ***C22C 30/02*** | (2006.01) |
| ***C22C 32/00*** | (2006.01) |

(52) U.S. Cl.

CPC ..... *C22C 29/14* (2013.01); *C22C 30/02* (2013.01); *C22C 32/0073* (2013.01); *C22C 32/0078* (2013.01); *C22C 32/0089* (2013.01); *B22F 3/14* (2013.01); *B22F 3/15* (2013.01); *B22F 2005/001* (2013.01); *B22F 2998/10* (2013.01); *B22F 2999/00* (2013.01); *C22C 29/18* (2013.01)

(56) References Cited

U.S. PATENT DOCUMENTS

| | | | |
|---|---|---|---|
| 11,033,998 | B2 | 6/2021 | Kavanaugh et al. |
| 2007/0224100 | A1 | 9/2007 | Kaner et al. |
| 2009/0186211 | A1 | 7/2009 | Chun et al. |
| 2012/0141293 | A1 | 6/2012 | Sato et al. |
| 2014/0041313 | A1 | 2/2014 | Kaner et al. |

FOREIGN PATENT DOCUMENTS

| | | | |
|---|---|---|---|
| JP | 2003268479 | A | 9/2003 |
| JP | 2011252195 | A | 12/2011 |
| WO | 2017/132286 | A1 | 8/2017 |

OTHER PUBLICATIONS

Kopeliovich, "Graphite molds for continuous casting", Subs Tech, (Jun. 22, 2013), (http://www.subtech.com/dokuwiki/doku.php?id=graphite_molds_for_continuous_casting), 1 page.

L G Bodrova et al., "Theory, Production Technology, and Properties of Powders and Fibers Preparation of Tungsten Tetraboride", Soviet Powder Metallurgy and Metal Ceramics, vol. 13, (Jan. 1, 1974), pp. 1-3, URL: http://rd.springer.com/content/pdf/10.1007/BF00790675.pdf, (Sep. 5, 2014), XP055138560 [A] 1-12 * the whole document *.

Notice of Reasons for Rejection issued in JP Patent Application No. 2022-056936 on Apr. 4, 2023.

Examination Report issued in EP Application No. 17744852.9 on Apr. 11, 2023.

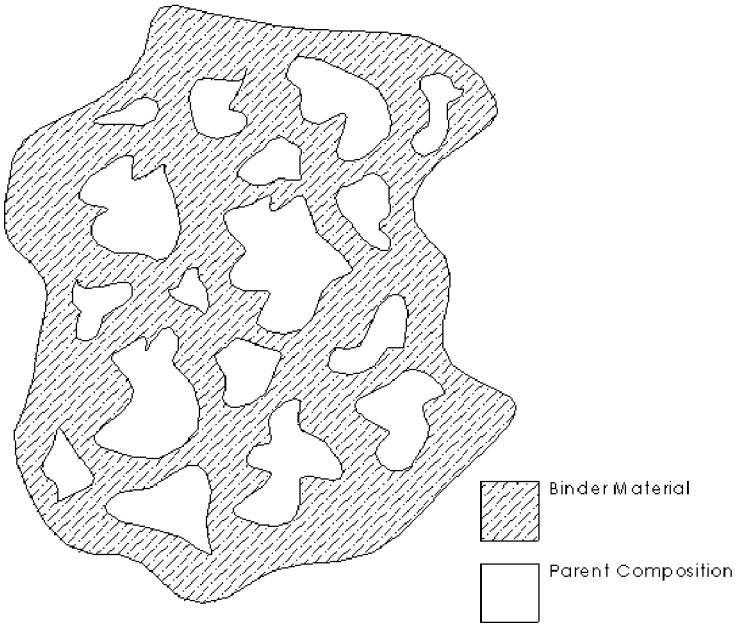
Binder Material
Parent Composition

BINDER COMPOSITIONS OF TUNGSTEN TETRABORIDE AND ABRASIVE METHODS THEREOF

CROSS-REFERENCE

This application is a continuation of U.S. application Ser. No. 17/307,600, filed May 4, 2021, now U.S. Pat. No. 11,752,593, issued Sep. 12, 2023, which is a continuation of U.S. application Ser. No. 15/415,553, filed Jan. 25, 2017, now U.S. Pat. No. 11,033,998, issued Jun. 15, 2021, which claims the benefit of U.S. Provisional Application No. 62/286,865, filed Jan. 25, 2016, all of which are incorporated herein by reference.

STATEMENT AS TO FEDERALLY SPONSORED RESEARCH

This invention was made with the support of the United States government under Contract number DMR-1506860 by the National Science Foundation, Division of Materials Research (DMR). The government has certain rights in the invention.

BACKGROUND OF THE INVENTION

Diamond has traditionally been the material of choice for abrasive applications, due to its superior mechanical properties, and particularly its hardness of >70 GPa. However, diamond is rare in nature and difficult to synthesize artificially due to the need for a combination of high temperature and high pressure conditions. Industrial applications of diamond are thus generally limited by cost. Moreover, diamond is not a desirable option for high-speed cutting of ferrous alloys due to its graphitization on the material's surface and formation of brittle carbides, which leads to poor cutting performance.

SUMMARY OF THE INVENTION

In some embodiments, described herein, is a composite material, comprising two compositions:

(a) the composition of a first formula $(W_{1-x}M_xX_y)_n$,
wherein:
- W is tungsten (W);
- X is one of boron (B), beryllium (Be), and silicon (Si);
- M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
- x is from 0.001 to 0.999;
- y is at least 2.0;
- n is from 0.001 to 0.999; and (b) the composition of a second formula $T_q$,
wherein:
- T is at least one element that comprises a group 4, 5, 6, 7, 8, 9, 10, 11, 12, 13, or 14 transition metal element in the Periodic Table of Elements;
- T may optionally comprise an alloy which is a combination of group 4, 5, 6, 7, 8, 9, 10, 11, 12, 13, or 14 transition metal elements in the Periodic Table of Elements;
- q is from 0.001 to 0.999; and wherein the sum of q and n is 1.

In some embodiments, a method of making the composite material is provided in which the first composition and the second composition are mixed and pressed under the force to produce a green pellet, which is then sintered in a high temperature vacuum furnace for some time to produce a fully densified tungsten tetraboride ($WB_4$) composite with binder. In some embodiments, a method of making the composite material is provided in which the first composition and the second composition are i) mixed and loaded into a graphite die to undergo a hydraulic compaction, and ii) are then loaded into a Spark Plasma Sintering furnace (SPS) or a high-temperature high-pressure furnace (HTHP) or a hot-isostatic press (HIP) to produce a fully densified tungsten tetraboride ($WB_4$) composite with binder.

In another aspect, described herein is a tool comprising a surface or body for cutting or abrading, said surface or body being at least a surface of a hard material, wherein said hard material comprises two compositions:

(a) the composition of a first formula $(W_{1-x}M_xX_y)_n$,
wherein:
- W is tungsten (W);
- X is one of boron (B), beryllium (Be), and silicon (Si);
- M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
- x is from 0.001 to 0.999;
- y is at least 2.0;
- n is from 0.001 to 0.999; and (b) the composition of a second formula $T_q$,
wherein:
- T is at least one element that comprises a group 4, 5, 6, 7, 8, 9, 10, 11, 12, 13, or 14 transition metal element in the Periodic Table of Elements;
- T may optionally comprise an alloy which is a combination of group 4, 5, 6, 7, 8, 9, 10, 11, 12, 13, or 14 transition metal elements in the Periodic Table of Elements;
- q is from 0.001 to 0.999; and wherein the sum of q and n is 1.

Also described herein, in certain embodiments, is a composite material, comprising two compositions:

(a) the composition comprising a first formula $(W_{1-x}M_xX_y)_n$,
wherein:
- W is tungsten (W);
- X is one of boron (B), beryllium (Be), and silicon (Si);
- M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
- x is from 0.001 to 0.999;
- y is at least 2.0;
- n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof, wherein:

X' is one of B, Be, and Si,

M is at least one of Hf, Zr, and Y;

q is from 0.001 to 0.999; and wherein the sum of q and n is 1; and wherein the second composition (b) encompasses the edges, in part or in whole, of the first composition, acting as a protective coating.

In another aspect, described herein is a tool comprising a surface or body for cutting or abrading, said surface or body being at least a surface of a hard material, wherein said hard material comprises two compositions, wherein:

(a) the composition comprising a first formula $(W_{1-x}M_xX_y)_n$, wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);

x is from 0.001 to 0.999;

y is at least 2.0;

n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof, wherein:

X' is one of B, Be, and Si,

M is at least one of Hf, Zr, and Y;

q is from 0.001 to 0.999; and wherein the sum of q and n is 1; and wherein the second composition (b) encompasses the edges, in part or in whole, of the first composition, acting as a protective coating.

BRIEF DESCRIPTION OF THE DRAWINGS

The novel features of the current subject matter are set forth with particularity in the appended claims. A better understanding of the features and advantages of the present subject matter will be obtained by reference to the following detailed description that sets forth illustrative embodiments, in which the principles of the subject matter are utilized, and the accompanying drawings of which:

Further objectives and advantages will become apparent from a consideration of the description, drawings, and examples.

FIG. 1. A non-limiting illustration of how the binder material will interact with and encompass the parent material. The binder content ratio to the parent composition displayed in this image is for example only and does not fully represent the ranges of binder material which may be used in the fullest extent of the subject matter described herein.

DETAILED DESCRIPTION OF THE INVENTION

Some embodiments of the current subject matter are discussed in detail below. In describing embodiments, specific terminology is employed for the sake of clarity. However, the current subject matter is not intended to be limited to the specific terminology so selected. A person skilled in the relevant art will recognize that other equivalent components can be employed and other methods developed without departing from the broad concepts of the current subject matter. All references cited anywhere in this specification, including the Background and Detailed Description sections, are incorporated by reference as if each had been individually incorporated.

Tungsten-Based Composite Material

Compositional variations of tungsten tetraboride ($WB_4$) with transition metals and light elements have been found to achieve the superior hardness as well as the wear-resistance to high-speed cutting. The toughness of the $W_{1-x}M_xX_y$ composition wherein:

W is tungsten (W);

X is one of boron (B), beryllium (Be) and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y) and aluminum (Al);

x is from 0.001 to 0.999;

y is at least 4.0;

is sometimes not satisfying in terms of abrasion. There is a long-felt and unmet need for a composite material with the combination of great toughness and hardness.

Described herein is a composite material of $W_{1-x}M_xX_y$ with an addition of a binder. In some aspects, described herein the binder material is, a Group 4-, 5-, 6-, 7-, 8-, 9-, 10-, 11-, 12-, 13-, or 14-metal of the Periodic Table of Elements, that has a beneficial presence as it increases and/or enhances fracture toughness, wear resistance, thermal conductivity, and/or ductility. In certain aspects, the amount of the binder present (as mass percent of the total mass) in the sintered composite varies depending on the particular application. For example, some applications may require higher fracture toughness; therefore the amount of binder necessary may be higher than an application requiring higher wear resistance, which would inherently use less binder. Examples of certain uses include, but are not limited to, hard-facing tooling, lathe inserts, downhole bit bodies, gauge pads, extrusion die surfaces, pneumatic and hydraulic pressure abrasion media heads.

The binder, by the way of non-limiting example, can comprise Fe, Co, Ni, or Cu, may introduce secondary phases, such as lower borides of Nickel (i.e. NiB), or may introduce complex secondary phases such as $W_2NiB_2$. In some embodiments, these phases exist at the grain boundaries of the parent composition crystallites.

In addition, the compositional variations of tungsten tetraboride ($WB_4$) with transitional metals and light elements perform well as cutting and/or abrading tools. Described herein is a protective coating containing any combination of M'X', $M'X'_2$, $M'X'_4$, $M'X'_6$, and $M'X'_{12}$, wherein X' is one of the boron (B), beryllium (Be), and silicon (Si), and M contains one or more elements selected from the group containing Hf, Zr, and Y; wherein the said coating is encompasses the edges of tungsten tetraboride ($WB_4$) with transition metals and light elements, which produces a composite material with much better high temperature oxidation resistance.

In other aspects, it is also highly desirable to improve the high temperature oxidation resistance of the $W_{1-x}M_xX_y$ composition. For example, improving oxidation resistance prevents excessive corrosive buildup. This, in turn, extends the life cycle of the composite, protecting the composite from attack, stress, and cracking while improving the ease of compression, welding, and/or fabrication.

In some embodiments, described herein, is a composite material, comprising two compositions:

(a) the composition of a first formula $(W_{1-x}M_xX_y)_n$, wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);

x is from 0.001 to 0.999;

y is at least 2.0;

n is from 0.001 to 0.999; and (b) the composition of a second formula $T_q$, wherein:

T is at least one element that comprises a group 4, 5, 6, 7, 8, 9, 10, 11, 12, 13, or 14 transition metal element in the Periodic Table of Elements;

T may optionally comprise an alloy which is a combination of group 4, 5, 6, 7, 8, 9, 10, 11, 12, 13, or 14 transition metal elements in the Periodic Table of Elements;

q is from 0.001 to 0.999; and wherein the sum of q and n is 1.

In some embodiments, X is B or Si. In some embodiments, X is Be or Si. In some embodiments, X is B. In some embodiments, X is Be. In some embodiments, X is Si. In some embodiments, M comprises at least one of Re, Ta, Mn, Cr, Hf, Ta, Zr, and Y. In some embodiments, M comprises at least one of Re, Ta, Mn, and Cr. In some embodiments, M comprises at least one of Ta, Mn, and Cr. In some embodiments, M comprises at least one of Hf, Zr, and Y. In some embodiments, M comprises two or more elements selected from Ti, V, Cr, Mn, Fe, Co, Ni, Cu, Zn, Zr, Nb, Mo, Ru, Hf, Ta, Re, Os, Ir, Li, Sc, Y, and Al. In some embodiments, M is selected from Re, Ta, Mn, Cr, Hf, Ta, Zr, Y, Ta, and Mn, or Ta and Cr. In some embodiments, M is selected from Re, Ta, Mn, Cr, and Mn, or Ta and Cr. In some embodiments, M comprises Ta and an element selected from Mn or Cr. In some embodiments, x is from 0.001 to 0.7. In some embodiments, x is from 0.001 to 0.4. In some embodiments, x is from 0.001 to 0.2. In some embodiments, y is at least 4. In some embodiments, X is B, M is Re, and x is at least 0.001 and less than 0.6. In some embodiments, X is B, M is Ta, and x is at least 0.001 and less than 0.6. In some embodiments, x is about 0.02. In some embodiments, X is B, M is Mn, and x is at least 0.001 and less than 0.6. In some embodiments, x is about 0.04. In some embodiments, X is B, M is Cr, and x is at least 0.001 and less than 0.6. In some embodiments, X is B, M comprises Ta and Mn, y is at least 4, and x is at least 0.001 and less than 0.4. In some embodiments, a composite material comprises $W_{0.94}Ta_{0.02}Mn_{0.04}B_4$. In some embodiments, X is B, M comprises Ta and Cr, y is at least 4, and x is at least 0.001 and less than 0.2. In some embodiments, a composite material comprises $W_{0.94}Ta_{0.02}Cr_{0.05}B_4$. In some embodiments, T is an alloy comprising at least one Group 8, 9, 10, 11, 12, 13 or 14 element in the Periodic Table of Elements. In some embodiments, T is an alloy comprising two or more, three or more, four or more, five or more, or six or more Group 4, 5, 6, 7, 8, 9, 10, 11, 12, 13, or 14 elements in the Periodic Table of Elements. In some embodiments, T is an alloy comprising at least one element selected from Cu, Ni, Co, Fe, Si, Al and Ti, or any combinations thereof. In some embodiments, T is an alloy comprises at least one element selected from Co, Ni, Fe, Si, Ti, W, Sn, Ta, or any combinations thereof. In some embodiments, T is an alloy comprising Co. In some embodiments, T is an alloy comprising Fe. In some embodiments, T is an alloy comprising Ni. In some embodiments, T is an alloy comprising Sn. In some embodiments, T is an alloy comprising from about 40 wt. % to about 60 wt. % of Cu, from about 10 wt. % to about 20 wt. % of Co, from 0 wt. % to about 7 wt. % of Sn, from about 5 wt. % to about 15 wt. % of Ni, and from about 10 wt. % to about 20 wt. % W. In some embodiments, T is an alloy comprising about 50 wt. % of Cu, about 20 wt. % of Co, about 5 wt. % of Sn, about 10 wt. % of Ni, and about 15 wt. % of W. In some embodiments, q and n are weight percentage ranges. In some embodiments, q is from 0.01 to 0.7. In some embodiments, q is from 0.1 to 0.3. In some embodiments, q is about 0.05, 0.1, 0.15, 0.2, 0.25, 0.3, 0.35, 0.4, 0.45, or 0.5. In some embodiments, q is from 0.7 to 0.8. In some embodiments, n is from 0.01 to 0.5. In some embodiments, n is about 0.05, 0.1, 0.15, 0.2, 0.25, 0.3, 0.35, 0.4, 0.45 or 0.5. In some embodiments, n is about 0.25. In some embodiments, the composite material forms a solid solution. In some embodiments, the composite material is resistant to oxidation. In some embodiments, the composite material is a densified composite material.

In some embodiments, a method of making the composite material is provided in which the first composition and the second composition are mixed and pressed under the force to produce a green pellet, which is then sintered in a high temperature vacuum furnace for some time to produce a fully densified tungsten tetraboride ($WB_4$) composite with binder. In some embodiments, a method of making the composite material is provided in which the first composition and the second composition are i) mixed and loaded into a graphite die to undergo a hydraulic compaction, and ii) are then loaded into a Spark Plasma Sintering furnace (SPS) or a high-temperature high-pressure furnace (HTHP) or a hot-isostatic press (HIP) to produce a fully densified tungsten tetraboride ($WB_4$) composite with binder.

In another aspect, described herein is a tool comprising a surface or body for cutting or abrading, said surface or body being at least a surface of a hard material, wherein said hard material comprises two compositions:

(a) the composition of a first formula $(W_{1-x}M_xX_y)_n$, wherein:

W is tungsten (W);

X is one of boron (B), beryllium (Be), and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);

x is from 0.001 to 0.999;

y is at least 2.0;

n is from 0.001 to 0.999; and (b) the composition of a second formula $T_q$,
wherein:
T is at least one element that comprises a group 4, 5, 6, 7, 8, 9, 10, 11, 12, 13, or 14 transition metal element in the Periodic Table of Elements;
T may optionally comprise an alloy which is a combination of group 4, 5, 6, 7, 8, 9, 10, 11, 12, 13, or 14 transition metal elements in the Periodic Table of Elements;
q is from 0.001 to 0.999; and
wherein the sum of q and n is 1.

In some embodiments, X is B. In some embodiments, M is one of Re, Ta, Mn, Cr, Ta and Mn, or Ta and Cr. In some embodiments, X is B and M is one of Re, Ta, Mn, Cr, Ta and Mn, or Ta and Cr. In some embodiments, T comprises at least one element that comprises iron (Fe), cobalt (Co) or nickel (Ni). In some embodiments, T comprises one element that comprises from iron (Fe), cobalt (Co) or nickel (Ni). In some embodiments, T is an alloy comprising Co. In some embodiments, T is an alloy comprising Fe. In some embodiments, T is an alloy comprising Ni. In some embodiments, T is an alloy comprising Sn. In some embodiments, T is an alloy comprising from about 40 wt. % to about 60 wt. % of Cu, from about 10 wt. % to about 20 wt. % of Co, from 0 wt. % to about 7 wt. % of Sn, from about 5 wt. % to about 15 wt. % of Ni, and from about 10 wt. % to about 20 wt. % W. In some embodiments, T is an alloy comprising about 50 wt. % of Cu, about 20 wt. % of Co, about 5 wt. % of Sn, about 10 wt. % of Ni, and about 15 wt. % of W. In some embodiments, the weight % range for the second composition is from 0.01 to 0.5. In some embodiments, the weight % range for the second composition is from 0.1 to 0.5. In some embodiments, the second composition is Co and the weight % range for the second composition is from 0.1 to 0.5.

In some embodiments, a method of making the composite material is provided that the first composition and the second composition are mixed and pressed under force to produce a green pellet, which is then sintered in a high temperature vacuum furnace for some time to produce a fully densified tungsten tetraboride ($WB_4$) composite with binder. In some embodiments, a method of making the composite material is provided that the first composition and the second composition are i) mixed and loaded into a graphite die to undergo a hydraulic compaction, and ii) are then loaded into a Spark Plasma Sintering furnace (SPS) or a high-temperature high-pressure furnace (HTHP) or a hot-isostatic press (HIP) to produce a fully densified tungsten tetraboride ($WB_4$) composite with binder.

Also described herein, in certain embodiments, is a composite material, comprising two compositions:

(a) the composition comprising a first formula $(W_{1-x}M_xX_y)_n$,
wherein:
W is tungsten (W);
X is one of boron (B), beryllium (Be), and silicon (Si);
M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
x is from 0.001 to 0.999;
y is at least 2.0;
n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof,
wherein:
X' is one of B, Be, and Si,
M is at least one of Hf, Zr, and Y;
q is from 0.001 to 0.999; and
wherein the sum of q and n is 1; and
wherein the second composition (b) encompasses the edges, in part or in whole, of the first composition, acting as a protective coating.

In some embodiments, X is B. In some embodiments, M is one of Re, Ta, Mn, Cr, Ta and Mn, or Ta and Cr. In some embodiments, X is B and M is one of Re, Ta, Mn, Cr, Ta and Mn, or Ta and Cr. In some embodiments, X' is B. In some embodiments, M' is one of Hf, Zr and Y.

In another aspect, described herein is a tool comprising a surface or body for cutting or abrading, said surface or body being at least a surface of a hard material, wherein said hard material comprises two compositions, wherein:

(a) the composition comprising a first formula $(W_{1-x}M_xX_y)_n$,
wherein:
W is tungsten (W);
X is one of boron (B), beryllium (Be), and silicon (Si);
M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
x is from 0.001 to 0.999;
y is at least 2.0;
n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof,
wherein:
X' is one of B, Be, and Si,
M is at least one of Hf, Zr, and Y;
q is from 0.001 to 0.999; and
wherein the sum of q and n is 1; and
wherein the second composition (b) encompasses the edges, in part or in whole, of the first composition, acting as a protective coating.

In some embodiments, X is B. In some embodiments, M is one of Re, Ta, Mn, Cr, Ta and Mn, or Ta and Cr. In some embodiments, X is B and M is one of Re, Ta, Mn, Cr, Ta and Mn, or Ta and Cr. In some embodiments, X is B. In some embodiments, M' is one of Hf, Zr and Y.

In some embodiments, described herein, is a composite material, comprising two compositions:

(a) the composition comprising a first formula $(W_{1-x}M_xX_y)_n$,
wherein:
W is tungsten (W);
X is one of boron (B), beryllium (Be), and silicon (Si);
M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);

x is from 0.001 to 0.999;

y is at least 2.0;

n is from 0.001 to 0.999; and (b) the composition comprising a second formula $T_q$, wherein:

T is at least one element that comprises a group 4, 5, 6, 7, 8, 9, 10, 11, 12, 13, or 14 transition metal element in the Periodic Table of Elements;

T may optionally comprise an alloy which is a combination of group 4, 5, 6, 7, 8, 9, 10, 11, 12, 13, or 14 transition metal elements in the Periodic Table of Elements;

q is from 0.001 to 0.999; and wherein the sum of q and n is 1.

In some embodiments, X from the first formula $W_{1-x}M_xX_y$ is one of B and Si. In some embodiments, X from the first formula $W_{1-x}M_xX_y$ is one of Be and Si. In some instances, X is B. In other instances, X is Si. In additional instances, X is Be.

In some embodiments, M comprises at least one of Re, Ta, Mn, Cr, Hf, Ta, Zr, and Y. In some embodiments, M comprises at least one of Re, Ta, Mn, and Cr. Sometimes, M can comprise at least one of Ta, Mn and Cr. Other times, M can comprise at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from Ti, V, Cr, Mn, Fe, Co, Ni, Cu, Zn, Zr, Nb, Mo, Ru, Hf, Ta, Re, Os, Ir, Li, Sc, Y, and Al. In some cases, M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, M is selected from Re, Ta, Mn, Cr, Hf, Ta, Zr, Y, and Mn, or Ta and Cr. In some embodiments, M is selected from Re, Ta, Mn, Cr, and Mn, or Ta and Cr. Sometimes, M can be selected from Ta, Mn, Cr, and Mn, or Ta and Cr. M can be Re. Other times, M can be selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li. M can be Sc. M can be Al.

Sometimes, x can have a value within the range 0.001 to 0.999, inclusively. Sometimes, x can have a value within the range 0.001 to 0.999, 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99. In some cases, x has a value of about 0.999.

In some embodiments, X is B, M is Re, and x is at least 0.001 and less than 0.1. In further embodiments, X is B, M is Re, and x is about 0.01. In further embodiments, M is one of Re, Ta, Mn, Cr, Ta and Mn, or Ta and Cr. In further embodiments, X is B and M is one of Re, Ta, Mn, Cr, Ta and Mn, or Ta and Cr. In further embodiments, X is B, M is Ta, and x is at least 0.001 and less than 0.05, or x is about 0.02. In further embodiments, X is B, M is Mn, and x is at least 0.001 and less than 0.4. In further embodiments, X is B, M is Cr, and x is at least 0.001 and less than 0.6.

In some embodiments, the composition consists essentially of W, Re and B, and x is at least 0.001 and less than 0.1. In further embodiments, the composition consists essentially of W, Re and B, and x is about 0.01.

In some embodiments, y is at least 2, 4, 6, 8, or 12. In some instances, y is at least 2. In other instances, y is at least 4. In some cases, y is at least 6. In some other cases, y is at least 8. In other cases y is at least 12.

In some embodiments, n is from 0.001 to 0.999. In some embodiments, n is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, n is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.5. In some cases, n is about 0.6. In some cases, n is about 0.7. In some cases, n is about 0.75. In some cases, n is about 0.8. In some cases, n is about 0.85. In some cases, n is about 0.9. In some cases, n is about 0.95. In some cases, n is about 0.99. In some cases, n is about 0.999.

In some embodiments, X is B and M comprises at least one of Re, Ta, Mn, Cr, Hf, Ta, Zr and Y. In some embodiments, X is B and M comprises at least one of Re, Ta, Mn and Cr. Sometimes, X is B and M can comprise at least one of Ta, Mn and Cr. Other times, X is B and M can comprise at least one of Hf, Zr, and Y. In some instances, X is B and M comprises at least Re. In some instances, X is B and M comprises at least Ta. In some instances, X is B and M comprises at least Mn. In some instances, X is B and M comprises at least Cr. In some cases, X is B and M comprises at least Hf. In some cases, X is B and M comprises at least Zr. In some cases, X is B and M comprises at least Y. In some cases, X is B and M comprises at least Ti. In some cases, X is B and M comprises at least V. In some cases, X is B and M comprises at least Co. In some cases, X is B and M comprises at least Ni. In some cases, X is B and M comprises at least Cu. In some cases, X is B and M comprises at least Zn. In some cases, X is B and M comprises at least Nb. In some cases, X is B and M comprises at least Mo. In some cases, X is B and M comprises at least Ru. In some cases, X is B and M comprises at least Os. In some cases, X is B and M comprises at least Ir. In some cases, X is B and M comprises at least Li.

In some instances, X is B and M comprises two or more elements selected from Ti, V, Cr, Mn, Fe, Co, Ni, Cu, Zn, Zr, Nb, Mo, Ru, Hf, Ta, Re, Os, Ir, Li, Y and Al. In some cases, X is B and M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, X is B and M comprises Ta and an element selected from Mn or Cr. In some cases, X is B and M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, X is B and M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, X is B and M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, X is B and M is selected from Re, Ta, Mn, Cr, Hf, Ta, Zr, Y, Ta and Mn, or Ta and Cr. In some embodiments, X is B and M is selected from Re, Ta, Mn, Cr, Ta and Mn, or Ta and Cr. Sometimes, X is B and M can be selected from Ta, Mn, Cr, Ta and Mn, or Ta and Cr. M can be Re. Other times, X is B and M can be selected from Hf, Zr, and Y. In some cases, X is B and M is Ta. In some cases, X is B and M is Mn. In some cases, X is B and M is Cr. In some cases, X is B and M is Ta and Mn. In some cases, X is B and M is Ta and Cr. In some cases, X is B and M is Hf. In some cases, X is B and M is Zr. In some cases, X is B and M is Y. In some cases, X is B and M is Ti. In some cases, X is B and M is V. In some cases, X is B and M is Co. In some cases, X is B and M is Ni. In some cases, X is B and M is Cu. In some cases, X is B and M is Zn. In some cases, X is B and M is Nb. In some cases, X is B and M is Mo. In some cases, X is B and M is Ru. In some cases, X is B and M is Os. In some cases, X is B and M is Ir. In some cases, X is B and M is Li.

In some embodiments, X is B, M is Re, and x is at least 0.001 and less than 0.6. In some embodiments, X is B, M is Re, and x is at least 0.001 and less than 0.5. In some embodiments, X is B, M is Re, and x is at least 0.001 and less than 0.4. In some embodiments, X is B, M is Re, and x is at least 0.001 and less than 0.3. In some embodiments, X is B, M is Re, and x is at least 0.001 and less than 0.2. In some embodiments, X is B, M is Re, and x is at least 0.001 and less than 0.1.

In some embodiments, X is B, M is Ta, and x is at least 0.001 and less than 0.6. In some embodiments, X is B, M is Ta, and x is at least 0.001 and less than 0.5. In some embodiments, X is B, M is Ta, and x is at least 0.001 and less than 0.4. In some embodiments, X is B, M is Ta, and x is at least 0.001 and less than 0.3. In some embodiments, X is B, M is Ta, and x is at least 0.001 and less than 0.2. In some embodiments, X is B, M is Ta, and x is at least 0.001 and less than 0.1. In some embodiments, X is B, M is Ta, and x is at least 0.001 and less than 0.05. In some embodiments, X is B, M is Ta, and x is about 0.02. In some embodiments, X is B, M is Ta, and x is about 0.04.

In some embodiments, X is B, M is Mn, and x is at least 0.001 and less than 0.6. In some embodiments, X is B, M is Mn, and x is at least 0.001 and less than 0.5. In some embodiments, X is B, M is Mn, and x is at least 0.001 and less than 0.4. In some embodiments, X is B, M is Mn, and x is at least 0.001 and less than 0.3. In some embodiments, X is B, M is Mn, and x is at least 0.001 and less than 0.2. In some embodiments, X is B, M is Mn, and x is at least 0.001 and less than 0.1. In some embodiments, X is B, M is Mn, and x is at least 0.001 and less than 0.05.

In some embodiments, X is B, M is Cr, and x is at least 0.001 and less than 0.6. In some embodiments, X is B, M is Cr, and x is at least 0.001 and less than 0.5. In some embodiments, X is B, M is Cr, and x is at least 0.001 and less than 0.4. In some embodiments, X is B, M is Cr, and x is at least 0.001 and less than 0.3. In some embodiments, X is B, M is Cr, and x is at least 0.001 and less than 0.2. In some embodiments, X is B, M is Cr, and x is at least 0.001 and less than 0.1. In some embodiments, X is B, M is Cr, and x is at least 0.001 and less than 0.05.

In some embodiments, X is B and M comprises Ta and Mn. In some embodiments, X is B and M is Ta and Mn. In some embodiments, X is B, M comprises Ta and Mn, and x is at least 0.001 and less than 0.6. In some instances, a composite material comprises $W_{0.94}Ta_{0.02}Mn_{0.04}B_y$, wherein y is at least 4. In some instances, a composite material comprises $W_{0.94}Ta_{0.02}Mn_{0.04}B_4$.

In some instances, X is B and M comprises Ta and Cr. In some instances, X is B and M is Ta and Cr. In some instances, X is B, M comprises Ta and Cr, and x is at least 0.001 and less than 0.6. In some instances, a composite material comprises $W_{0.93}Ta_{0.02}Cr_{0.05}B_y$, wherein y is at least 4. In some instances, a composite material comprises $W_{0.93}Ta_{0.02}Cr_{0.05}B_4$.

In some embodiments, a composite material described herein comprises $WB_4$.

T from the second formula $T_q$ comprises at least one Group 4, 5, 6, 7, 8, 9, 10, 11, 12, 13, or 14 element in the Periodic Table of Elements. Sometimes, T comprises at least one Group 8, 9, 10, 11, 12, 13 or 14 element in the Periodic Table of Elements. In some instances, T comprises at least one Group 4 element in the Periodic Table of Elements. In some instances T comprises at least one Group 5 element in the Periodic Table of Elements. In some instances, T comprises at least one Group 6 element in the Periodic Table of Elements. In some instances, T comprises at least one Group 7 element in the Periodic Table of Elements. In some instances, T comprises at least one Group 8 element in the Periodic Table of Elements. In some instances, T comprises at least one Group 9 element in the Periodic Table of Elements. In some instances, T comprises at least one Group 10 element in the Periodic Table of Elements. In some instances, T comprises at least one Group 11 element in the Periodic Table of Elements. In some instances, T comprises at least one Group 12 element in the Periodic Table of Elements. In some instances, T comprises at least one Group 13 element in the Periodic Table of Elements. In some instances, T comprises at least one Group 14 element in the Periodic Table of Elements.

T from the second formula $T_q$ may comprise an alloy comprising at least one Group 4, 5, 6, 7, 8, 9, 10, 11, 12, 13, or 14 element in the Periodic Table of Elements. Sometimes, T can be an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T may comprise Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. The weight percentage of Co may be about 10 wt. % to about 20 wt. %, or may be about 20 wt. %. The weight percentage of Sn may be less than 7 wt. %, may be up to 7 wt. %, or may be about 5 wt. %. The weight percentage of Ni may be about 5 wt. % to about 15 wt. %, or may be about 10 wt. %. The weight percentage of W may be about 15 wt. %.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $T_q$ in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $T_q$. In some instances, the composite material in a solid solution phase comprises a tungsten-based compound of a first formula $(W_{1-x}M_xB_4)_n$ and a second formula $T_q$. In some instances, the composite material in a solid solution phase comprises a tungsten-based compound of a first formula $(WB_4)_n$ and a second formula $T_q$.

In some embodiments, a composite material described herein has a hardness of about 10 to about 70 GPa. In some instances, a composite material described herein has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite material described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite material described herein has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite material described herein has a hardness of about 10 GPa or higher. In some embodiments, a composite material described herein has a hardness of about 15 GPa or higher. In some embodiments, a composite material described herein has a hardness of about 20 GPa or higher. In some embodiments, a composite material described herein has a hardness of about 25 GPa or higher. In some embodiments, a composite material described herein has a hardness of about 30 GPa or higher. In some embodiments, a composite material described herein has a hardness of about 31 GPa or higher. In some embodiments, a composite material described herein has a hardness of about 32 GPa or higher. In some embodiments, a composite material described herein has a hardness of about 33 GPa or higher. In some embodiments, a composite material described herein has a hardness of about 34 GPa or higher. In some embodiments, a composite material described herein has a hardness of about 35 GPa or higher. In some embodiments, a composite material described herein has a hardness of about 36 GPa or higher. In some embodiments, a composite material described herein has a hardness of about 37 GPa or higher. In some embodiments, a composite material described herein has a hardness of about 38 GPa or higher. In some embodiments, a composite material described herein has a hardness of about 39 GPa or higher. In some embodiments, a composite material described herein has a hardness of about 40 GPa or higher. In some embodiments, a composite material described herein has a hardness of about 41 GPa or higher. In some embodiments, a composite material described herein has a hardness of about 42 GPa or higher.

In some embodiments, a composite material described herein has a hardness of about 43 GPa or higher. In some embodiments, a composite material described herein has a hardness of about 44 GPa or higher. In some embodiments, a composite material described herein has a hardness of about 45 GPa or higher. In some embodiments, a composite material described herein has a hardness of about 46 GPa or higher. In some embodiments, a composite material described herein has a hardness of about 47 GPa or higher. In some embodiments, a composite material described herein has a hardness of about 48 GPa or higher. In some embodiments, a composite material described herein has a hardness of about 49 GPa or higher. In some embodiments, a composite material described herein has a hardness of about 50 GPa or higher. In some embodiments, a composite material described herein has a hardness of about 51 GPa or higher. In some embodiments, a composite material described herein has a hardness of about 52 GPa or higher. In some embodiments, a composite material described herein has a hardness of about 53 GPa or higher. In some embodiments, a composite material described herein has a hardness of about 54 GPa or higher. In some embodiments, a composite material described herein has a hardness of about 55 GPa or higher. In some embodiments, a composite material described herein has a hardness of about 56 GPa or higher. In some embodiments, a composite material described herein has a hardness of about 57 GPa or higher. In some embodiments, a composite material described herein has a hardness of about 58 GPa or higher. In some embodiments, a composite material described herein has a hardness of about 59 GPa or higher. In some embodiments, a composite material described herein has a hardness of about 60 GPa or higher.

In some embodiments, a composite material described herein has a bulk modulus of about 330 GPa to about 350 GPa.

In some embodiments, a composite material described herein has a grain size of about 20 μm or less. In some instances, the composite material has a grain size of about 15 μm or less, about 12 μm or less, about 10 μm or less, about 8 μm or less, about 5 μm or less, about 2 μm or less or about 1 μm or less. In some cases, the composite material has a grain size of about 15 μm or less. In some cases, the composite material has a grain size of about 12 μm or less. In some cases, the composite material has a grain size of about 10 μm or less. In some cases, the composite material has a grain size of about 9 μm or less. In some cases, the composite material has a grain size of about 8 μm or less. In some cases, the composite material has a grain size of about 7 μm or less. In some cases, the composite material has a grain size of about 6 μm or less. In some cases, the composite material has a grain size of about 5 μm or less. In some cases, the composite material has a grain size of about 4 μm or less. In some cases, the composite material has a grain size of about 3 μm or less. In some cases, the composite material has a grain size of about 2 μm or less. In some cases, the composite material has a grain size of about 1 μm or less.

In some instances, the grain size is an averaged grain size. In some cases, a composite material described herein has an averaged grain size of about 20 μm or less. In some instances, the composite material has an averaged grain size of about 15 μm or less, about 12 μm or less, about 10 μm or less, about 8 μm or less, about 5 μm or less, about 2 μm or less or about 1 μm or less. In some cases, the composite material has an averaged grain size of about 15 μm or less. In some cases, the composite material has an averaged grain size of about 12 μm or less. In some cases, the composite material has an averaged grain size of about 10 μm or less. In some cases, the composite material has an averaged grain size of about 9 μm or less. In some cases, the composite material has an averaged grain size of about 8 μm or less. In some cases, the composite material has an averaged grain size of about 7 μm or less. In some cases, the composite material has an averaged grain size of about 6 μm or less. In some cases, the composite material has an averaged grain size of about 5 μm or less. In some cases, the composite material has an averaged grain size of about 4 μm or less. In some cases, the composite material has an averaged grain size of about 3 μm or less. In some cases, the composite material has an averaged grain size of about 2 μm or less. In some cases, the composite material has an averaged grain size of about 1 μm or less.

In some embodiments, a composite material described herein is a densified composite material. In some instances, the densified composite material comprises a tungsten-based compound of the first formula $(W_{1-x}M_xX_y)_n$ and compound of the second formula $T_q$. In some instances, the densified composite material comprises a tungsten-based compound of the first formula $(W_{1-x}M_xB_4)_n$ and compound of the second formula $T_q$. In some instances, the densified composite material comprises a tungsten-based compound of the first formula $WB_4$, and compound of the second formula $T_q$.

Composite Material—Tungsten Tetraboride $(W_{1-x}M_xB_4)_n$

In some embodiments, a composite material described herein comprising:

(a) the composition of a first formula $(W_{1-x}M_xB_4)_n$, wherein:
- W is tungsten (W);
- B is boron (B);
- M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), and aluminum (Al);
- x is from 0.001 to 0.999;
- n is from 0.001 to 0.999; and (b) the composition of a second formula $T_q$, wherein:
- T is at least one element that comprises a group 4, 5, 6, 7, 8, 9, 10, 11, 12, 13, or 14 transition metal element in the Periodic Table of Elements;
- T may optionally comprise an alloy which is a combination of group 4, 5, 6, 7, 8, 9, 10, 11, 12, 13, or 14 transition metal elements in the Periodic Table of Elements;
- q is from 0.001 to 0.999; and wherein the sum of q and n is 1.

In some embodiments, M comprises at least one of Re, Ta, Mn, Cr, Hf, Ta, Zr and Y. In some embodiments, M comprises at least one of Re, Ta, Mn and Cr. Sometimes, M can comprise at least one of Ta, Mn and Cr. Other times, M can comprise at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li.

In some instances, M comprises two or more elements selected from Ti, V, Cr, Mn, Fe, Co, Ni, Cu, Zn, Zr, Nb, Mo, Ru, Hf, Ta, Re, Os, Ir, Li, Sc, Y, and Al. In some cases, M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M can be selected from Ta, Mn, Cr, Ta and Mn, or Ta and Cr. M can be Re. Other times, M can be selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li. M can be Sc. M can be Al.

Sometimes, x can have a value within the range 0.001 to 0.999, inclusively. Sometimes, x can have a value within the range 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99. In some cases, x has a value of about 0.999.

In some embodiments, M is Re and x is at least 0.001 and less than 0.6. In some embodiments, M is Re and x is at least 0.001 and less than 0.5. In some embodiments, M is Re and x is at least 0.001 and less than 0.4. In some embodiments, M is Re and x is at least 0.001 and less than 0.3. In some embodiments, M is Re and x is at least 0.001 and less than 0.2. In some embodiments, M is Re and x is at least 0.001 and less than 0.1.

In some embodiments, M is Ta and x is at least 0.001 and less than 0.6. In some embodiments, M is Ta and x is at least 0.001 and less than 0.5. In some embodiments, M is Ta and x is at least 0.001 and less than 0.4. In some embodiments, M is Ta and x is at least 0.001 and less than 0.3. In some embodiments, M is Ta and x is at least 0.001 and less than 0.2. In some embodiments, M is Ta and x is at least 0.001 and less than 0.1. In some embodiments, M is Ta and x is at least 0.001 and less than 0.05. In some embodiments, M is Ta and x is about 0.02. In some embodiments, M is Ta and x is about 0.04.

In some embodiments, M is Mn and x is at least 0.001 and less than 0.6. In some embodiments, M is Mn and x is at least 0.001 and less than 0.5. In some embodiments, M is Mn and x is at least 0.001 and less than 0.4. In some embodiments, M is Mn and x is at least 0.001 and less than 0.3. In some embodiments, M is Mn and x is at least 0.001 and less than 0.2. In some embodiments, M is Mn and x is at least 0.001 and less than 0.1. In some embodiments, M is Mn and x is at least 0.001 and less than 0.05.

In some embodiments, M is Cr, and x is at least 0.001 and less than 0.6. In some embodiments, M is Cr and x is at least 0.001 and less than 0.5. In some embodiments, M is Cr and x is at least 0.001 and less than 0.4. In some embodiments, M is Cr and x is at least 0.001 and less than 0.3. In some embodiments, M is Cr and x is at least 0.001 and less than 0.2. In some embodiments, M is Cr and x is at least 0.001 and less than 0.1. In some embodiments, M is Cr and x is at least 0.001 and less than 0.05.

In some embodiments, M comprises Ta and Mn. In some embodiments, M is Ta and Mn. In some embodiments, M comprises Ta and Mn, and x is at least 0.001 and less than 0.6. In some instances, a composite material comprises $W_{0.94}Ta_{0.02}Mn_{0.04}B_4$.

In some instances, M comprises Ta and Cr. In some instances, M is Ta and Cr. In some instances, M comprises Ta and Cr, and x is at least 0.001 and less than 0.6. In some instances, a composite material comprises $W_{0.93}Ta_{0.02}Cr_{0.05}B_4$.

In some instances, n is about 0.001, 0.005, 0.01, 0.05, 0.1, 0.15, 0.2, 0.25, 0.3, 0.35, 0.4, 0.45 or 0.5. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5.

In some cases, T is an alloy comprising at least one Group 4, 5, 6, 7, 8, 9, 10, 11, 12, 13, or 14 element in the Periodic Table of Elements. Sometimes, T can be an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T may comprise Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. The weight percentage of Co may be about 10 wt. % to about 20 wt. %, or may be about 20 wt. %. The weight percentage of Sn may be less than 7 wt. %, may be up to 7 wt. %, or may be about 5 wt. %. The weight percentage of Ni may be about 5 wt. % to about 15 wt. %, or may be about 10 wt. %. The weight percentage of W may be about 15 wt. %.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Cu_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Ni_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Co_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Fe_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Si_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Al_q$; wherein q is from 0.001 to 0.999; and wherein the sum of q and n is 1.

In some embodiments, a composite material described herein comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al); x is from 0.001 to 0.999; and (b) a second formula $Ti_q$; wherein q is from 0.001 to 0.999; and wherein the sum of q and n is 1.

Composite Material—Tungsten Tetraboride ($WB_4$)

In some embodiments, a composite material described herein comprising:

(a) a tungsten tetraboride of formula $(WB_4)_n$, wherein n is from 0.001 to 0.999; and (b) a second formula $T_q$, wherein:

T is an alloy comprising at least one Group 4, 5, 6, 7, 8, 9, 10, 11, 12, 13, or 14 element in the Periodic Table of Elements;

T may optionally comprise an alloy which is a combination of group 4, 5, 6, 7, 8, 9, 10, 11, 12, 13, or 14 transition metal elements in the Periodic Table of Elements;

q is from 0.001 to 0.999; and wherein the sum of q and n is 1.

In some cases, T is an alloy comprising at least one Group 4, 5, 6, 7, 8, 9, 10, 11, 12, 13, or 14 element in the Periodic Table of Elements. Sometimes, T can be an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T may comprise Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. The weight percentage of Co may be about 10 wt. % to about 20 wt. %, or may be about 20 wt. %. The weight percentage of Sn may be less than 7 wt. %, may be up to 7 wt. %, or may be about 5 wt. %. The weight percentage of Ni may be about 5 wt. % to about 15 wt. %, or may be about 10 wt. %. The weight percentage of W may be about 15 wt. %.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some instances, n is about 0.001, 0.005, 0.01, 0.05, 0.1, 0.15, 0.2, 0.25, 0.3, 0.35, 0.4, 0.45 or 0.5. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5.

In some cases, as used herein, q and n are weight percentage ranges.

In some embodiments, a composite material described herein comprising: (a) a tungsten tetraboride of formula $(WB_4)_n$, wherein n is from 0.001 to 0.999; and (b) a second formula $Cu_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.099; and (b) a second formula $Ni_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.999; and (b) a second formula $Co_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.999; and (b) a second formula $Fe_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.999; and (b) a second formula $Si_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.999; and (b) a second formula $Al_q$; wherein q is from 0.001 to 0.999; and wherein the sum of q and n is 1.

In some embodiments, a composite material described herein comprising: (a) a tungsten tetraboride of formula $(WB_4)_n$, wherein n is from 0.001 to 0.999; and (b) a second formula $Ti_q$; wherein q is from 0.001 to 0.999; and wherein the sum of q and n is 1.

Tungsten-Based Composite Material Comprising Beryllium

In some embodiments, described herein is a composite material which comprises:

(a) a first formula $(W_{1-x}M_xBe_y)_n$ wherein:

W is tungsten (W);

Be is beryllium (Be);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), Scandium (Sc), and aluminum (Al);

x is from 0.001 to 0.999;

y is at least 2.0;

n is from 0.001 to 0.999; and (b) a second formula $T_q$, wherein:

T is at least one element that comprises a group 4, 5, 6, 7, 8, 9, 10, 11, 12, 13, or 14 transition metal element in the Periodic Table of Elements;

T may optionally comprise an alloy which is a combination of group 4, 5, 6, 7, 8, 9, 10, 11, 12, 13, or 14 transition metal elements in the Periodic Table of Elements;

q is from 0.001 to 0.999; and wherein the sum of q and n is 1.

In some embodiments, M comprises at least one of Re, Ta, Mn, Cr, Hf, Ta, Zr and Y. In some embodiments, M comprises at least one of Re, Ta, Mn and Cr. Sometimes, M can comprise at least one of Ta, Mn and Cr. Other times, M can comprise at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li. In some cases, M comprises at least Sc. In some cases, M comprises at least Al.

In some instances, M comprises two or more elements selected from Ti, V, Cr, Mn, Fe, Co, Ni, Cu, Zn, Zr, Nb, Mo, Ru, Hf, Ta, Re, Os, Ir, Li, Y, Sc, and Al. In some cases, M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M can be selected from Ta, Mn, Cr, Ta and Mn, or Ta and Cr. M can be Re. Other times, M can be selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li. M can be Sc. M can be Al.

Sometimes, x can have a value within the range 0.001 to 0.999, inclusively. Sometimes, x can have a value within the range 0.001 to 0.999, 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.95. In some cases, x has a value of about 0.99. In some cases, x has a value of about 0.999.

In some embodiments, y is at least 2, 4, 6, or 12. In some instances, y is at least 2. In some cases, y is at least 4. In some cases, y is at least 6. In some cases y is at least 12.

In some instances, n is about 0.001, 0.005, 0.01, 0.05, 0.1, 0.15, 0.2, 0.25, 0.3, 0.35, 0.4, 0.45 or 0.5. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5.

T from the second formula $T_q$ can be an alloy comprising at least one Group 4, 5, 6, 7, 8, 9, 10, 11, 12, 13, or 14 element in the Periodic Table of Elements. Sometimes, T can be an alloy comprising at least one Group 8, 9, 10, 11, 12, 13 or 14 element in the Periodic Table of Elements. In some instances, T is an alloy comprising a at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising T. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T may comprise Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. The weight percentage of Co may be about 10 wt. % to about 20 wt. %, or may be about 20 wt. %. The weight percentage of Sn may be less than 7 wt. %, may be up to 7 wt. %, or may be about 5 wt. %. The weight percentage of Ni may be about 5 wt. % to about 15 wt. %, or may be about 10 wt. %. The weight percentage of W may be about 15 wt. %.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material comprising beryllium is resistant to oxidation. In some embodiments, a composite material comprising beryllium has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $T_q$ in the composite material inhibits the formation of oxidation or reduces the rate of oxidation.

In some embodiments, a composite material comprising beryllium comprises a solid solution phase. In some embodiments, a composite material comprising beryllium forms a solid solution. In some instances, the composite material in a solid solution phase comprises a tungsten-based compound of a first formula $(W_{1-x}M_xBe_y)_n$, and a second formula $T_q$.

In some embodiments, a composite material comprising beryllium has a hardness of about 10 to about 70 GPa. In some instances, a composite material comprising beryllium has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite material described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite material comprising beryllium has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite material comprising beryllium has a hardness of about 10 GPa or higher. In some embodiments, a composite material comprising beryllium has a hardness of about 15 GPa or higher. In some embodiments, a composite material comprising beryllium has a hardness of about 20 GPa or higher. In some embodiments, a composite material comprising beryllium has a hardness of about 25 GPa or higher. In some embodiments, a composite material comprising beryllium has a hardness of about 30 GPa or higher. In some embodiments, a composite material comprising beryllium has a hardness of about 31 GPa or higher. In some embodiments, a composite material comprising beryllium has a hardness of about 32 GPa or higher. In some embodiments, a composite material comprising beryllium has a hardness of about 33 GPa or higher. In some embodiments, a composite material comprising beryllium has a hardness of about 34 GPa or higher. In some embodiments, a composite material comprising beryllium has a hardness of about 35 GPa or higher. In some embodiments, a composite material comprising beryllium has a hardness of about 36 GPa or higher. In some embodiments, a composite material comprising beryllium has a hardness of about 37 GPa or higher. In some embodiments, a composite material comprising beryllium has a hardness of about 38 GPa or higher. In some embodiments, a composite material comprising beryllium has a hardness of about 39 GPa or higher. In some embodiments, a composite material comprising beryllium has a hardness of about 40 GPa or higher. In some embodiments, a composite material comprising beryllium has a hardness of about 41 GPa or higher. In some embodiments, a composite material comprising beryllium has a hardness of about 42 GPa or higher. In some embodiments, a composite material comprising beryllium has a hardness of about 43 GPa or higher. In some embodiments, a composite material comprising beryllium has a hardness of about 44 GPa or higher. In some embodiments, a composite material comprising beryllium has a hardness of about 45 GPa or higher. In some embodiments, a composite material comprising beryllium has a hardness of about 46 GPa or higher. In some embodiments, a composite material comprising beryllium has a hardness of about 47 GPa or higher. In some embodiments, a composite material comprising beryllium has a hardness of about 48 GPa or higher. In some embodiments, a composite material comprising beryllium has a hardness of about 49 GPa or higher. In some embodiments, a composite material comprising beryllium has a hardness of about 50 GPa or higher. In some embodiments, a composite material comprising beryllium has a hardness of about 51 GPa or higher. In some embodiments, a composite material comprising beryllium has a hardness of about 52 GPa or higher. In some embodiments, a composite material comprising beryllium has a hardness of about 53 GPa or higher. In some embodiments, a composite material comprising beryllium has a hardness of about 54 GPa or higher. In some embodiments, a composite material comprising beryllium has a hardness of about 55 GPa or higher. In some embodiments, a composite material comprising beryllium has a hardness of about 56 GPa or higher. In some embodiments, a composite material comprising beryllium has a hardness of about 57 GPa or higher. In some embodiments, a composite material comprising beryllium has a hardness of about 58 GPa or higher. In some embodiments, a composite material comprising beryllium has a hardness of about 59 GPa or higher. In some embodiments, a composite material comprising beryllium has a hardness of about 60 GPa or higher.

In some embodiments, a composite material comprising beryllium has a bulk modulus of about 330 GPa to about 350 GPa.

In some embodiments, a composite material comprising beryllium has a grain size of about 20 μm or less. In some instances, the composite material has a grain size of about 15 μm or less, about 12 μm or less, about 10 μm or less, about 8 μm or less, about 5 μm or less, about 2 μm or less or about 1 μm or less. In some cases, the composite material has a grain size of about 15 μm or less. In some cases, the composite material has a grain size of about 12 μm or less. In some cases, the composite material has a grain size of about 10 μm or less. In some cases, the composite material has a grain size of about 9 μm or less. In some cases, the composite material has a grain size of about 8 μm or less. In some cases, the composite material has a grain size of about 7 μm or less. In some cases, the composite material has a grain size of about 6 μm or less. In some cases, the composite material has a grain size of about 5 μm or less. In some cases, the composite material has a grain size of about 4 μm or less. In some cases, the composite material has a grain size of about 3 μm or less. In some cases, the composite material has a grain size of about 2 μm or less. In some cases, the composite material has a grain size of about 1 μm or less.

In some instances, the grain size is an averaged grain size. In some cases, a composite material comprising beryllium has an averaged grain size of about 20 μm or less. In some instances, the composite material has an averaged grain size of about 15 μm or less, about 12 μm or less, about 10 μm or less, about 8 μm or less, about 5 μm or less, about 2 μm or less or about 1 μm or less. In some cases, the composite material has an averaged grain size of about 15 μm or less. In some cases, the composite material has an averaged grain size of about 12 μm or less. In some cases, the composite material has an averaged grain size of about 10 μm or less. In some cases, the composite material has an averaged grain size of about 9 μm or less. In some cases, the composite material has an averaged grain size of about 8 μm or less. In some cases, the composite material has an averaged grain size of about 7 μm or less. In some cases, the composite material has an averaged grain size of about 6 μm or less. In some cases, the composite material has an averaged grain size of about 5 μm or less. In some cases, the composite material has an averaged grain size of about 4 μm or less. In some cases, the composite material has an averaged grain size of about 3 μm or less. In some cases, the composite material has an averaged grain size of about 2 μm or less. In some cases, the composite material has an averaged grain size of about 1 μm or less.

In some embodiments, a composite material comprising beryllium is a densified composite material. In some instances, the densified composite material comprises a tungsten-based compound of a first formula $(W_{1-x}M_xBe_y)_n$ and a second formula $T_q$.

Tungsten-Based Composite Material Comprising Silicon

In some embodiments, described herein is a composite material which comprises:

(a) a first formula $(W_{1-x}M_xSi_y)_n$ wherein:

W is tungsten (W);

Si is silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y), scandium (Sc), and aluminum (Al);

x is from 0.001 to 0.999;

y is at least 2.0; and n is from 0.001 to 0.999; and (b) a second formula $T_q$:

wherein:

T is at least one element that comprises a group 4, 5, 6, 7, 8, 9, 10, 11, 12, 13, or 14 transition metal element in the Periodic Table of Elements;

T may optionally comprise an alloy which is a combination of group 4, 5, 6, 7, 8, 9, 10, 11, 12, 13, or 14 transition metal elements in the Periodic Table of Elements;

q is from 0.001 to 0.999; and wherein the sum of q and n is 1.

In some embodiments, M comprises at least one of Re, Ta, Mn, Cr, Hf, Ta, Zr and Y. In some embodiments, M comprises at least one of Re, Ta, Mn and Cr. Sometimes, M can comprise at least one of Ta, Mn and Cr. Other times, M can comprise at least one of Hf, Zr, and Y. In some instances, M comprises at least Re. In some instances, M comprises at least Ta. In some instances, M comprises at least Mn. In some instances, M comprises at least Cr. In some cases, M comprises at least Hf. In some cases, M comprises at least Zr. In some cases, M comprises at least Y. In some cases, M comprises at least Ti. In some cases, M comprises at least V. In some cases, M comprises at least Co. In some cases, M comprises at least Ni. In some cases, M comprises at least Cu. In some cases, M comprises at least Zn. In some cases, M comprises at least Nb. In some cases, M comprises at least Mo. In some cases, M comprises at least Ru. In some cases, M comprises at least Os. In some cases, M comprises at least Ir. In some cases, M comprises at least Li. In some cases, M comprises at least Sc. In some cases, M comprises at least Al.

In some instances, M comprises two or more elements selected from titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al). In some cases, M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, M comprises Ta and an element selected from Mn or Cr. In some cases, M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, M is selected from Re, Ta, Mn, Cr, Hf, Ta, Zr, Y, Ta and Mn, or Ta and Cr. In some embodiments, M is selected from Re, Ta, Mn, Cr, Ta and Mn, or Ta and Cr. Sometimes, M can be selected from Ta, Mn, Cr, Ta and Mn, or Ta and Cr. M can be Re. Other times, M can be selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li. M can be Sc. M can be Al.

Sometimes, x can have a value within the range 0.001 to 0.999, inclusively. Sometimes, x can have a value within the range 0.001 to 0.999, 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.95. In some cases, x has a value of about 0.99. In some cases, x has a value of about 0.999.

In some embodiments, y is at least 2, 4, 6, or 12. In some instances, y is at least 2. In some cases, y is at least 4. In some cases, y is at least 6. In some cases y is at least 12.

In some instances, n is about 0.001, 0.005, 0.01, 0.05, 0.1, 0.15, 0.2, 0.25, 0.3, 0.35, 0.4, 0.45 or 0.5. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.45. In some cases, n is about 0.5.

T from the second formula $T_q$ can be an alloy comprising at least one Group 4, 5, 6, 7, 8, 9, 10, 11, 12, 13, or 14 element in the Periodic Table of Elements. Sometimes, T can be an alloy comprising at least one Group 8, 9, 10, 11, 12, 13 or 14 element in the Periodic Table of Elements. In some instances, T is an alloy comprising at least one Group 4 element in the Periodic Table of Elements. In some instances, T is an alloy comprising at least one Group 5 element in the Periodic Table of Elements. In some instances, T is an alloy comprising at least one Group 6 element in the Periodic Table of Elements. In some instances, T is an alloy comprising at least one Group 7 element in the Periodic Table of Elements. In some instances, T is an alloy comprising at least one Group 8 element in the Periodic Table of Elements. In some instances, T is an alloy comprising at least one Group 9 element in the Periodic Table of Elements. In some instances, T is an alloy comprising at least one Group 10 element in the Periodic Table of Elements. In some instances, T is an alloy comprising at least one Group 11 element in the Periodic Table of Elements. In some instances, T is an alloy comprising at least one Group 12 element in the Periodic Table of Elements. In some instances, T is an alloy comprising at least one Group 13 element in the Periodic Table of Elements. In some instances, T is an alloy comprising at least one Group 14 element in the Periodic Table of Elements.

In some instances, T is an alloy comprising at least one element selected from Cu, Ni, Co, Fe, Si, Al and Ti. In some cases, T is an alloy comprising at least one element selected from Cu, Co, Fe, Ni, Ti and Si. In some cases, T is an alloy comprising at least one element selected from Cu, Co, Fe and Ni. In some cases, T is an alloy comprising at least one element selected from Co, Fe and Ni. In some cases, T is an alloy comprising at least one element selected from Al, Ti and Si. In some cases, T is an alloy comprising at least one element selected from Ti and Si. In some embodiments, T is an alloy comprising Cu. In some embodiments, T is an alloy comprising Ni. In some embodiments, T is an alloy comprising Co. In some embodiments, T is an alloy comprising Fe. In some embodiments, T is an alloy comprising Si. In some embodiments, T is an alloy comprising Al. In some embodiments, T is an alloy comprising Ti.

In some instances, T is an alloy comprising two or more, three or more, four or more, five or more, or six or more Group 4, 5, 6, 7, 8, 9, 10, 11, 12, 13, or 14 elements in the Periodic Table of Elements. In some cases, T is an alloy comprising two or more, three or more, four or more, five or more, or six or more Group 8, 9, 10, 11, 12, 13, or 14 elements in the Periodic Table of Elements. Sometimes, the alloy T may comprise Cu, and optionally in combination with one or more of Co, Ni, Fe, Si, Ti, W, Sn, or Ta. In some cases, the alloy T comprises Co, Ni, Fe, Si, Ti, W, Sn, Ta, or any combinations thereof. In such alloy, the weight percentage of Cu may be about 40 wt. % to about 60 wt. %, or may be about 50 wt. %. The weight percentage of Co may be about 10 wt. % to about 20 wt. %, or may be about 20 wt. %. The weight percentage of Sn may be less than 7 wt. %, may be up to 7 wt. %, or may be about 5 wt. %. The weight percentage of Ni may be about 5 wt. % to about 15 wt. %, or may be about 10 wt. %. The weight percentage of W may be about 15 wt. %.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material comprising silicon is resistant to oxidation. In some embodiments, a composite material comprising silicon has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $T_q$ in the composite material inhibits the formation of oxidation or reduces the rate of oxidation.

In some embodiments, a composite material comprising silicon comprises a solid solution phase. In some embodiments, a composite material comprising silicon forms a solid solution. In some instances, the composite material in a solid solution phase comprises a tungsten-based compound of a first formula $(W_{1-x}M_xSi_y)_n$ and a second formula $T_q$.

In some embodiments, a composite material comprising silicon has a hardness of about 10 to about 70 GPa. In some instances, a composite material comprising silicon has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite material described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite material comprising silicon has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite material comprising silicon has a hardness of about 10 GPa or higher. In some embodiments, a composite material comprising silicon has a hardness of about 15 GPa or higher. In some embodiments, a composite material comprising silicon has a hardness of about 20 GPa or higher. In some embodiments, a composite material comprising silicon has a hardness of about 25 GPa or higher. In some embodiments, a composite material comprising silicon has a hardness of about 30 GPa or higher. In some embodiments, a composite material comprising silicon has a hardness of about 31 GPa or higher. In some embodiments, a composite material comprising silicon has a hardness of about 32 GPa or higher. In some embodiments, a composite material comprising silicon has a hardness of about 33 GPa or higher. In some embodiments, a composite material comprising silicon has a hardness of about 34 GPa or higher. In some embodiments, a composite material comprising silicon has a hardness of about 35 GPa or higher. In some embodiments, a composite material comprising silicon has a hardness of about 36 GPa or higher. In some embodiments, a composite material comprising silicon has a hardness of about 37 GPa or higher. In some embodiments, a composite material comprising silicon has a hardness of about 38 GPa or higher. In some embodiments, a composite material comprising silicon has a hardness of about 39 GPa or higher. In some embodiments, a composite material comprising silicon has a hardness of about 40 GPa or higher. In some embodiments, a composite material comprising silicon has a hardness of about 41 GPa or higher. In some embodiments, a composite material comprising silicon has a hardness of about 42 GPa or higher. In some embodiments, a composite material comprising silicon has a hardness of about 43 GPa or higher. In some embodiments, a composite material comprising silicon has a hardness of about 44 GPa or higher. In some embodiments, a composite material comprising silicon has a hardness of about 45 GPa or higher. In some embodiments, a composite material comprising silicon has a hardness of about 46 GPa or higher. In some embodiments, a composite material comprising silicon has a hardness of about 47 GPa or higher. In some embodiments, a composite material comprising silicon has a hardness of about 48 GPa or higher. In some embodiments, a composite material comprising silicon has a hardness of about 49 GPa or higher. In some embodiments, a composite material comprising silicon has a hardness of about 50 GPa or higher. In some embodiments, a composite material comprising silicon has a hardness of about 51 GPa or higher. In some embodiments, a composite material comprising silicon has a hardness of about 52 GPa or higher. In some embodiments, a composite material comprising silicon has a hardness of about 53 GPa or higher. In some embodiments, a composite material comprising silicon has a hardness of about 54 GPa or higher. In some embodiments, a composite material comprising silicon has a hardness of about 55 GPa or higher. In some embodiments, a composite material comprising silicon has a hardness of about 56 GPa or higher. In some embodiments, a composite material comprising silicon has a hardness of about 57 GPa or higher. In some embodiments, a composite material comprising silicon has a hardness of about 58 GPa or higher. In some embodiments, a composite material comprising silicon has a hardness of about 59 GPa or higher. In some embodiments, a composite material comprising silicon has a hardness of about 60 GPa or higher.

In some embodiments, a composite material comprising silicon has a bulk modulus of about 330 GPa to about 350 GPa.

In some embodiments, a composite material comprising silicon has a grain size of about 20 μm or less. In some instances, the composite material has a grain size of about 15 μm or less, about 12 μm or less, about 10 μm or less, about 8 μm or less, about 5 μm or less, about 2 μm or less or about 1 μm or less. In some cases, the composite material has a grain size of about 15 μm or less. In some cases, the composite material has a grain size of about 12 μm or less. In some cases, the composite material has a grain size of about 10 μm or less. In some cases, the composite material has a grain size of about 9 μm or less. In some cases, the composite material has a grain size of about 8 μm or less. In some cases, the composite material has a grain size of about 7 μm or less. In some cases, the composite material has a grain size of about 6 μm or less. In some cases, the composite material has a grain size of about 5 μm or less. In some cases, the composite material has a grain size of about 4 μm or less. In some cases, the composite material has a grain size of about 3 μm or less. In some cases, the composite material has a grain size of about 2 μm or less. In some cases, the composite material has a grain size of about 1 μm or less.

In some instances, the grain size is an averaged grain size. In some cases, a composite material comprising silicon has an averaged grain size of about 20 μm or less. In some instances, the composite material has an averaged grain size of about 15 μm or less, about 12 μm or less, about 10 μm or less, about 8 μm or less, about 5 μm or less, about 2 μm or less or about 1 μm or less. In some cases, the composite material has an averaged grain size of about 15 μm or less. In some cases, the composite material has an averaged grain size of about 12 μm or less. In some cases, the composite material has an averaged grain size of about 10 μm or less. In some cases, the composite material has an averaged grain size of about 9 μm or less. In some cases, the composite material has an averaged grain size of about 8 μm or less. In some cases, the composite material has an averaged grain size of about 7 μm or less. In some cases, the composite material has an averaged grain size of about 6 μm or less. In some cases, the composite material has an averaged grain size of about 5 μm or less. In some cases, the composite material has an averaged grain size of about 4 μm or less. In some cases, the composite material has an averaged grain size of about 3 μm or less. In some cases, the composite material has an averaged grain size of about 2 μm or less. In some cases, the composite material has an averaged grain size of about 1 μm or less.

In some embodiments, a composite material comprising silicon is a densified composite material. In some instances, the densified composite material comprises a tungsten-based compound of a first formula $(W_{1-x}M_xSi_y)_n$ and $T_q$.

Also described herein, in certain embodiments, is a tool comprising a surface or body for cutting or abrading, said surface or body being at least a surface of a hard material, wherein said hard material comprises two compositions:

(a) the first composition comprising a first formula $(W_{1-x}M_xX_y)_n$,
wherein:
- W is tungsten (W);
- X is one of boron (B), beryllium (Be) and silicon (Si);
- M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);
- x is from 0.001 to 0.999;
- y is at least 2.0;
- n is from 0.001 to 0.999; and (b) the composition comprising a second formula $T_q$,
wherein:
- T is at least one element that comprises a group 4, 5, 6, 7, 8, 9, 10, 11, 12, 13, or 14 transition metal element in the Periodic Table of Elements;
- T may optionally comprise an alloy which is a combination of group 4, 5, 6, 7, 8, 9, 10, 11, 12, 13, or 14 transition metal elements in the Periodic Table of Elements;
- q is from 0.001 to 0.999; and wherein the sum of q and n is 1.

Also described herein is a composite material of $W_{1-x}M_xX_y$ with the addition of a dopant. In some aspects, described herein is a dopant material, for example of a Group 4-, 5-, 6-, 7-, 8-, 9-, 10-, 11-, 12-, 13-, or 14-metal of the Periodic Table of Elements, that has a beneficial presence as it increases and/or enhances fracture toughness, wear resistance, thermal conductivity, and/or ductility. In certain aspects, the amount of binder material present (as mass percent of the total mass) in the sintered composite varies depending on the particular application. For example, some applications may require higher fracture toughness; therefore the amount of binder necessary may be higher than an application requiring higher wear resistance, which would inherently use less binder. Examples of certain uses include, but are not limited to, hard-facing tooling, lathe inserts, downhole bit bodies, gauge pads, extrusion die surfaces, pneumatic and hydraulic pressure abrasion media heads.

In certain embodiments described herein, is a composite material, comprising two compositions:

(a) the composition comprising a first formula $(W_{1-x}M_xX_y)_n$, wherein:

W is tungsten (W);

X is one of boron (B), beryllium (Be) and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y) and aluminum (Al);

x is from 0.001 to 0.999;

y is at least 2.0;

n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof, wherein:

X' is one of B, Be, and Si,

M is at least one of Hf, Zr, and Y;

q is from 0.001 to 0.999; and wherein the sum of q and n is 1; and wherein the second composition (b) encompasses the edges, in part or in whole, of the first composition, acting as a protective coating.

In some embodiments, X from the first formula $W_{1-x}M_xX_y$ is one of B and Si. In some embodiments, X from the first formula $W_{1-x}M_xX_y$ is one of Be and Si. In some instances, X is B. In other instances, X is Si. In additional instances, X is Be.

In some embodiments, X is B. In some embodiments, M is one of Re, Ta, Mn, Cr, Ta and Mn, or Ta and Cr. In some embodiments, X is B and M is one of Re, Ta, Mn, Cr, Ta and Mn, or Ta and Cr.

In some embodiments, M is selected from Re, Ta, Mn, Cr, Hf, Ta, Zr, Y, and Mn, or Ta and Cr. In some embodiments, M is selected from Re, Ta, Mn, Cr, and Mn, or Ta and Cr. Sometimes, M can be selected from Ta, Mn, Cr, and Mn, or Ta and Cr. M can be Re. Other times, M can be selected from Hf, Zr, and Y. M can be Ta. M can be Mn. M can be Cr. M can be Ta and Mn. M can be Ta and Cr. M can be Hf. M can be Zr. M can be Y. M can be Ti. M can be V. M can be Co. M can be Ni. M can be Cu. M can be Zn. M can be Nb. M can be Mo. M can be Ru. M can be Os. M can be Ir. M can be Li. M can be Sc. M can be Al.

Sometimes, x can have a value within the range 0.001 to 0.999, inclusively. Sometimes, x can have a value within the range 0.001 to 0.999, 0.005 to 0.99, 0.01 to 0.95, 0.05 to 0.9, 0.1 to 0.9, 0.001 to 0.6, 0.005 to 0.6, 0.01 to 0.6, 0.05 to 0.6, 0.1 to 0.6, 0.2 to 0.6, 0.3 to 0.6, 0.4 to 0.6, 0.001 to 0.55, 0.005 to 0.55, 0.01 to 0.55, 0.05 to 0.55, 0.1 to 0.55, 0.2 to 0.55, 0.3 to 0.55, 0.4 to 0.55, 0.45 to 0.55, 0.001 to 0.5, 0.005 to 0.5, 0.01 to 0.5, 0.05 to 0.5, 0.1 to 0.5, 0.2 to 0.5, 0.3 to 0.5, 0.4 to 0.5, 0.5 to 0.55, 0.45 to 0.5, 0.001 to 0.4, 0.005 to 0.4, 0.01 to 0.4, 0.05 to 0.4, 0.1 to 0.4, 0.2 to 0.4, 0.001 to 0.3, 0.005 to 0.3, 0.01 to 0.3, 0.05 to 0.3, 0.1 to 0.3, 0.001 to 0.2, 0.005 to 0.2, 0.01 to 0.2, 0.05 to 0.2, or 0.1 to 0.2, inclusively. In some cases, x has a value within the range 0.1 to 0.9, inclusively. In some instances, x has a value within the range 0.001 to 0.6, 0.005 to 0.6, 0.001 to 0.4, or 0.001 to 0.2, inclusively. In some instances, x has a value within the range 0.001 to 0.6, inclusively. In some additional instances, x has a value within the range 0.001 to 0.5, inclusively. In some additional instances, x has a value within the range 0.001 to 0.4, inclusively. In some additional instances, x has a value within the range 0.001 to 0.3, inclusively. In some additional instances, x has a value within the range 0.001 to 0.2, inclusively. In some additional instances, x has a value within the range 0.01 to 0.6, inclusively. In some additional instances, x has a value within the range 0.01 to 0.5, inclusively. In some additional instances, x has a value within the range 0.01 to 0.4, inclusively. In some additional instances, x has a value within the range 0.01 to 0.3, inclusively. In some additional instances, x has a value within the range 0.01 to 0.2, inclusively. In some additional instances, x has a value within the range 0.1 to 0.8, inclusively. In some additional instances, x has a value within the range 0.1 to 0.7, inclusively. In some additional instances, x has a value within the range 0.1 to 0.6, inclusively. In some additional instances, x has a value within the range 0.1 to 0.5, inclusively. In some additional instances, x has a value within the range 0.1 to 0.4, inclusively. In some additional instances, x has a value within the range 0.1 to 0.3, inclusively. In some additional instances, x has a value within the range 0.1 to 0.2, inclusively. In some additional instances, x has a value within the range 0.2 to 0.8, inclusively. In some additional instances, x has a value within the range 0.2 to 0.7, inclusively. In some additional instances, x has a value within the range 0.2 to 0.6, inclusively. In some additional instances, x has a value within the range 0.2 to 0.5, inclusively. In some additional instances, x has a value within the range 0.2 to 0.4, inclusively. In some additional instances, x has a value within the range 0.2 to 0.3, inclusively. In some additional instances, x has a value within the range 0.3 to 0.8, inclusively. In some additional instances, x has a value within the range 0.3 to 0.7, inclusively. In some additional instances, x has a value within the range 0.3 to 0.6, inclusively. In some additional instances, x has a value within the range 0.3 to 0.5, inclusively. In some additional instances, x has a value within the range 0.3 to 0.4, inclusively. In some additional instances, x has a value within the range 0.4 to 0.8, inclusively. In some additional instances, x has a value within the range 0.4 to 0.7, inclusively. In some additional instances, x has a value within the range 0.4 to 0.6, inclusively. In some additional instances, x has a value within the range 0.4 to 0.5, inclusively.

In some embodiments, x is at least 0.001 and less than 0.999. In some embodiments, x is at least 0.001 and less than 0.9. In some cases, x is at least 0.001 and less than 0.6. In some cases, x is at least 0.001 and less than 0.5. In some cases, x is at least 0.001 and less than 0.4. In some cases, x is at least 0.001 and less than 0.3. In some cases, x is at least 0.001 and less than 0.2. In some cases, x is at least 0.001 and less than 0.05. In some cases, x is at least 0.01 and less than 0.5. In some cases, x is at least 0.01 and less than 0.4. In some cases, x is at least 0.01 and less than 0.3. In some cases, x is at least 0.01 and less than 0.2. In some cases, x is at least 0.1 and less than 0.5. In some cases, x is at least 0.1 and less than 0.4. In some cases, x is at least 0.1 and less than 0.3. In some cases, x is at least 0.1 and less than 0.2.

In some cases, x has a value of about 0.001, 0.005, 0.01, 0.05, 0.1, 0.15, 0.2, 0.25, 0.3, 0.35, 0.4, 0.41, 0.42, 0.43, 0.44, 0.45, 0.46, 0.47, 0.48, 0.49, 0.5, 0.51, 0.52, 0.53, 0.54, 0.55, 0.56, 0.57, 0.58, 0.59, 0.6, 0.65, 0.7, 0.8, 0.9, 0.95, 0.99 or about 0.999. In some cases, x has a value of about 0.001. In some cases, x has a value of about 0.005. In some cases, x has a value of about 0.01. In some cases, x has a value of about 0.05. In some cases, x has a value of about 0.1. In some cases, x has a value of about 0.15. In some cases, x has a value of about 0.2. In some cases, x has a value of about 0.3. In some cases, x has a value of about 0.4. In some cases, x has a value of about 0.41. In some cases, x has a value of about 0.42. In some cases, x has a value of about 0.43. In some cases, x has a value of about 0.44. In some cases, x has a value of about 0.45. In some cases, x has a value of about 0.46. In some cases, x has a value of about 0.47. In some cases, x has a value of about 0.48. In some cases, x has a value of about 0.49. In some cases, x has a value of about 0.5. In some cases, x has a value of about 0.51. In some cases, x has a value of about 0.52. In some cases, x has a value of about 0.53. In some cases, x has a value of about 0.54. In some cases, x has a value of about 0.55. In some cases, x has a value of about 0.56. In some cases, x has a value of about 0.57. In some cases, x has a value of about 0.58. In some cases, x has a value of about 0.59. In some cases, x has a value of about 0.6. In some cases, x has a value of about 0.7. In some cases, x has a value of about 0.8. In some cases, x has a value of about 0.9. In some cases, x has a value of about 0.99. In some cases, x has a value of about 0.999.

In some embodiments, X is B, M is Re, and x is at least 0.001 and less than 0.1. In further embodiments, X is B, M is Re, and x is about 0.01. In further embodiments, M is one of Re, Ta, Mn, Cr, Ta and Mn, or Ta and Cr. In further embodiments, X is B and M is one of Re, Ta, Mn, Cr, Ta and Mn, or Ta and Cr. In further embodiments, X is B, M is Ta, and x is at least 0.001 and less than 0.05, or x is about 0.02. In further embodiments, X is B, M is Mn, and x is at least 0.001 and less than 0.4. In further embodiments, X is B, M is Cr, and x is at least 0.001 and less than 0.6.

In some embodiments, the composition consists essentially of W, Re and B, and x is at least 0.001 and less than 0.1. In further embodiments, the composition consists essentially of W, Re and B, and x is about 0.01.

In some embodiments, y is at least 2, 4, 6, 8, or 12. In some instances, y is at least 2. In other instances, y is at least 4. In some cases, y is at least 6. In some other cases, y is at least 8. In other cases y is at least 12.

In some embodiments, n is from 0.001 to 0.999. In some embodiments, n is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some cases, n is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, n is about 0.001. In some cases, n is about 0.005. In some cases, n is about 0.01. In some cases, n is about 0.05. In some cases, n is about 0.1. In some cases, n is about 0.15. In some cases, n is about 0.2. In some cases, n is about 0.25. In some cases, n is about 0.3. In some cases, n is about 0.35. In some cases, n is about 0.4. In some cases, n is about 0.5. In some cases, n is about 0.6. In some cases, n is about 0.7. In some cases, n is about 0.75. In some cases, n is about 0.8. In some cases, n is about 0.85. In some cases, n is about 0.9. In some cases, n is about 0.95. In some cases, n is about 0.99. In some cases, n is about 0.999.

In some embodiments, X is B and M comprises at least one of Re, Ta, Mn, Cr, Hf, Ta, Zr and Y. In some embodiments, X is B and M comprises at least one of Re, Ta, Mn and Cr. Sometimes, X is B and M can comprise at least one of Ta, Mn and Cr. Other times, X is B and M can comprise at least one of Hf, Zr, and Y. In some instances, X is B and M comprises at least Re. In some instances, X is B and M comprises at least Ta. In some instances, X is B and M comprises at least Mn. In some instances, X is B and M comprises at least Cr. In some cases, X is B and M comprises at least Hf. In some cases, X is B and M comprises at least Zr. In some cases, X is B and M comprises at least Y. In some cases, X is B and M comprises at least Ti. In some cases, X is B and M comprises at least V. In some cases, X is B and M comprises at least Co. In some cases, X is B and M comprises at least Ni. In some cases, X is B and M comprises at least Cu. In some cases, X is B and M comprises at least Zn. In some cases, X is B and M comprises at least Nb. In some cases, X is B and M comprises at least Mo. In some cases, X is B and M comprises at least Ru. In some cases, X is B and M comprises at least Os. In some cases, X is B and M comprises at least Ir. In some cases, X is B and M comprises at least Li.

In some instances, X is B and M comprises two or more elements selected from Ti, V, Cr, Mn, Fe, Co, Ni, Cu, Zn, Zr, Nb, Mo, Ru, Hf, Ta, Re, Os, Ir, Li, Y and Al. In some cases, X is B and M comprises Ta and an element selected from Ti, V, Cr, Mn, Fe, Co, Ni, Cu, Zn, Zr, Nb, Mo, Ru, Hf, Re, Os, Ir, Li, Y and Al. In some cases, X is B and M comprises Ta and an element selected from Mn or Cr. In some cases, X is B and M comprises Hf and an element selected from Ti, V, Cr, Mn, Fe, Co, Ni, Cu, Zn, Zr, Nb, Mo, Ru, Re, Os, Ir, Li, Ta, Y and Al. In some cases, X is B and M comprises Zr and an element selected from Ti, V, Cr, Mn, Fe, Co, Ni, Cu, Zn, Ta, Nb, Mo, Ru, Hf, Re, Os, Ir, Li, Y and Al. In some cases, X is B and M comprises Y and an element selected from Ti, V, Cr, Mn, Fe, Co, Ni, Cu, Zn, Ta, Nb, Mo, Ru, Hf, Re, Os, Ir, Li, Zr and Al.

In some embodiments, X is B and M is selected from Re, Ta, Mn, Cr, Hf, Ta, Zr, Y, Ta and Mn, or Ta and Cr. In some embodiments, X is B and M is selected from Re, Ta, Mn, Cr, Ta and Mn, or Ta and Cr. Sometimes, X is B and M can be selected from Ta, Mn, Cr, Ta and Mn, or Ta and Cr. M can be Re. Other times, X is B and M can be selected from Hf, Zr, and Y. In some cases, X is B and M is Ta. In some cases, X is B and M is Mn. In some cases, X is B and M is Cr. In some cases, X is B and M is Ta and Mn. In some cases, X is B and M is Ta and Cr. In some cases, X is B and M is Hf. In some cases, X is B and M is Zr. In some cases, X is B and M is Y. In some cases, X is B and M is Ti. In some cases, X is B and M is V. In some cases, X is B and M is Co. In some cases, X is B and M is Ni. In some cases, X is B and M is Cu. In some cases, X is B and M is Zn. In some cases, X is B and M is Nb. In some cases, X is B and M is Mo. In some cases, X is B and M is Ru. In some cases, X is B and M is Os. In some cases, X is B and M is Ir. In some cases, X is B and M is Li.

In some embodiments, X is B, M is Re, and x is at least 0.001 and less than 0.6. In some embodiments, X is B, M is Re, and x is at least 0.001 and less than 0.5. In some embodiments, X is B, M is Re, and x is at least 0.001 and less than 0.4. In some embodiments, X is B, M is Re, and x is at least 0.001 and less than 0.3. In some embodiments, X is B, M is Re, and x is at least 0.001 and less than 0.2. In some embodiments, X is B, M is Re, and x is at least 0.001 and less than 0.1.

In some embodiments, X is B, M is Ta, and x is at least 0.001 and less than 0.6. In some embodiments, X is B, M is Ta, and x is at least 0.001 and less than 0.5. In some embodiments, X is B, M is Ta, and x is at least 0.001 and less than 0.4. In some embodiments, X is B, M is Ta, and x is at least 0.001 and less than 0.3. In some embodiments, X is B, M is Ta, and x is at least 0.001 and less than 0.2. In some embodiments, X is B, M is Ta, and x is at least 0.001 and less than 0.1. In some embodiments, X is B, M is Ta, and x is at least 0.001 and less than 0.05. In some embodiments, X is B, M is Ta, and x is about 0.02. In some embodiments, X is B, M is Ta, and x is about 0.04.

In some embodiments, X is B, M is Mn, and x is at least 0.001 and less than 0.6. In some embodiments, X is B, M is Mn, and x is at least 0.001 and less than 0.5. In some embodiments, X is B, M is Mn, and x is at least 0.001 and less than 0.4. In some embodiments, X is B, M is Mn, and x is at least 0.001 and less than 0.3. In some embodiments, X is B, M is Mn, and x is at least 0.001 and less than 0.2. In some embodiments, X is B, M is Mn, and x is at least 0.001 and less than 0.1. In some embodiments, X is B, M is Mn, and x is at least 0.001 and less than 0.05.

In some embodiments, X is B, M is Cr, and x is at least 0.001 and less than 0.6. In some embodiments, X is B, M is Cr, and x is at least 0.001 and less than 0.5. In some embodiments, X is B, M is Cr, and x is at least 0.001 and less than 0.4. In some embodiments, X is B, M is Cr, and x is at least 0.001 and less than 0.3. In some embodiments, X is B, M is Cr, and x is at least 0.001 and less than 0.2. In some embodiments, X is B, M is Cr, and x is at least 0.001 and less than 0.1. In some embodiments, X is B, M is Cr, and x is at least 0.001 and less than 0.05.

In some embodiments, X is B and M comprises Ta and Mn. In some embodiments, X is B and M is Ta and Mn. In some embodiments, X is B, M comprises Ta and Mn, and x is at least 0.001 and less than 0.6. In some instances, a composite material comprises $W_{0.94}Ta_{0.02}Mn_{0.04}B_y$, wherein y is at least 4. In some instances, a composite material comprises $W_{0.94}Ta_{0.02}Mn_{0.04}B_4$.

In some instances, X is B and M comprises Ta and Cr. In some instances, X is B and M is Ta and Cr. In some instances, X is B, M comprises Ta and Cr, and x is at least 0.001 and less than 0.6. In some instances, a composite material comprises $W_{0.93}Ta_{0.02}Cr_{0.05}B_y$, wherein y is at least 4. In some instances, a composite material comprises $W_{0.93}Ta_{0.02}Cr_{0.05}B_4$.

In some embodiments, a composite material described herein comprises $WB_4$.

In some embodiments, X' is B. In some embodiments, M' is one of Hf, Zr and Y. In some embodiments, X' is B and M' is Hf. In some embodiments, X' is B and M' is Zr. In some embodiments, X' is B and M' is Y. In other embodiments, X' is B, and M' comprises Hf and Y. In other embodiments, X' is B and M' comprises Hf and Y. In other embodiments, X' is B and M' comprises Zr and Y. Yet in other embodiments, X' is B and M' comprises Hf, Zr, and Y.

In some embodiments, X' is B, M' is Hf, and the second formula is HfB. In some embodiments, X' is B, M' is Hf, and the second formula is $HfB_2$. In some embodiments, X' is B, M' is Hf, and the second formula is a combination of HfB and $HfB_2$.

In some embodiments, X' is B, M' is Zr, and the second formula is ZrB. In some embodiments, X' is B, M' is Zr, and the second formula is $ZrB_2$. In some embodiments, X' is B, M' is Zr, and the second formula is a combination of ZrB and $ZrB_2$.

In some embodiments, X' is B, M' is Y, and the second formula is $YB_2$. In some embodiments, X' is B, M' is Y, and the second formula is $YB_4$. In some embodiments, X' is B, M' is Y, and the second formula is $YB_6$. In some embodiments, X' is B, M' is Y, and the second formula is $YB_{12}$. In some embodiments, X' is B, M' is Y, and the second formula is a combination of $YB_2$ and $YB_4$. In some embodiments, X' is B, M' is Y, and the second formula is a combination of $YB_2$ and $YB_6$. In some embodiments, X' is B, M' is Y, and the second formula is a combination of $YB_2$ and $YB_{12}$. In some embodiments, X' is B, M' is Y, and the second formula is a combination of $YB_4$ and $YB_6$. In some embodiments, X' is B, M' is Y, and the second formula is a combination of $YB_4$ and $YB_{12}$. In some embodiments, X' is B, M' is Y, and the second formula is a combination of $YB_6$ and $YB_{12}$. In some embodiments, X' is B, M' is Y, and the second formula is a combination of $YB_2$, $YB_4$, and $YB_6$. In some embodiments, X' is B, M' is Y, and the second formula is a combination of $YB_2$, $YB_4$, and $YB_{12}$. In some embodiments, X' is B, M' is Y, and the second formula is a combination of $YB_4$, $YB_6$, and $YB_{12}$. In some embodiments, X' is B, M' is Y, and the second formula is a combination of $YB_2$, $YB_6$, and $YB_{12}$. In some embodiments, X' is B, M' is Y, and the second formula is a combination of $YB_2$, $YB_4$, $YB_6$, and $YB_{12}$.

In some embodiments, q is from 0.001 to 0.999. In some embodiments, q is from 0.001 to 0.999, 0.005 to 0.999, 0.01 to 0.999, 0.05 to 0.999, 0.1 to 0.999, 0.15 to 0.999, 0.2 to 0.999, 0.25 to 0.999, 0.35 to 0.999, 0.4 to 0.999, 0.5 to 0.999, 0.6 to 0.999, 0.7 to 0.999, 0.8 to 0.999, 0.001 to 0.99, 0.005 to 0.99, 0.01 to 0.99, 0.05 to 0.99, 0.1 to 0.99, 0.15 to 0.99, 0.2 to 0.99, 0.25 to 0.99, 0.35 to 0.99, 0.4 to 0.99, 0.5 to 0.99, 0.6 to 0.99, 0.7 to 0.99, 0.8 to 0.99, 0.01 to 0.9, 0.05 to 0.9, 0.1 to 0.9, 0.15 to 0.9, 0.2 to 0.9, 0.25 to 0.9, 0.3 to 0.9, 0.35 to 0.9, 0.4 to 0.9, 0.5 to 0.9, 0.6 to 0.9, 0.7 to 0.9, 0.8 to 0.9, 0.01 to 0.8, 0.05 to 0.8, 0.1 to 0.8, 0.15 to 0.8, 0.2 to 0.8, 0.25 to 0.8, 0.3 to 0.8, 0.4 to 0.8, 0.5 to 0.8, 0.6 to 0.8, 0.7 to 0.8, 0.01 to 0.7, 0.05 to 0.7, 0.1 to 0.7, 0.2 to 0.7, 0.3 to 0.7, 0.4 to 0.7, 0.5 to 0.7, 0.01 to 0.6, 0.05 to 0.6, 0.1 to 0.6, 0.2 to 0.6, 0.3 to 0.6, 0.01 to 0.5, 0.05 to 0.5, 0.1 to 0.5, 0.2 to 0.5, 0.01 to 0.4, 0.05 to 0.4, 0.1 to 0.4, 0.2 to 0.4, 0.01 to 0.3, 0.05 to 0.3, 0.1 to 0.3, 0.2 to 0.3, 0.75 to 0.99, 0.75 to 0.9, 0.75 to 0.8, 0.8 to 0.99, or 0.8 to 0.9.

In some embodiments, q is about 0.001, 0.005, 0.01, 0.05, 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 0.99, or about 0.999. In some cases, q is about 0.001. In some cases, q is about 0.005. In some cases, q is about 0.01. In some cases, q is about 0.05. In some cases, q is about 0.1. In some cases, q is about 0.15. In some cases, q is about 0.2. In some cases, q is about 0.25. In some cases, q is about 0.3. In some cases, q is about 0.35. In some cases, q is about 0.4. In some cases, q is about 0.5. In some cases, q is about 0.6. In some cases, q is about 0.7. In some cases, q is about 0.75. In some cases, q is about 0.8. In some cases, q is about 0.85. In some cases, q is about 0.9. In some cases, q is about 0.95. In some cases, q is about 0.99. In some cases, q is about 0.999.

In some cases, as used herein, q and n are weight percentage ranges.

In some embodiments, a composite material described herein is resistant to oxidation. In some embodiments, a composite material described herein has anti-oxidation property. For example, when the composite material is coated on the surface of a tool, the composite material reduces the rate of oxidation of the tool in comparison to a tool not coated with the composite material. In an alternative example, when the composite material is coated on the surface of a tool, the composite material prevents oxidation of the tool in comparison to a tool not coated with the composite material. In some instances, $(M'X')_q$, $(M'X'_2)_q$, $(M'X'_4)_q$, $(M'X'_6)_q$, or $(M'X'_{12})_q$, or a combination thereof, in the composite material inhibits the formation of oxidation or reduces the rate of oxidation.

In some embodiments, a composite material described herein comprises a solid solution phase. In some embodiments, a composite material described herein forms a solid solution. In some instances, the composite material in a solid solution phase comprises a tungsten-based compound of a first formula $(W_{1-x}M_xX_y)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(W_{1-x}M_xB_4)_n$ and a second formula $(M'X')_q$, $(M'X'_2)_q$, $(M'X'_4)_q$, $(M'X'_6)_q$, or $(M'X'_{12})_q$, or a combination thereof. In some instances, the composite material in a solid solution phase comprises a tungsten-based compound of a first formula $(WB_4)_n$ and a second formula $(M'X')_q$, $(M'X'_2)_q$, $(M'X'_4)_q$, $(M'X'_6)_q$, or $(M'X'_{12})_q$, or a combination thereof.

In some embodiments, a composite material described herein has a hardness of about 10 to about 70 GPa. In some instances, a composite material described herein has a hardness of about 10 to about 60 GPa, about 10 to about 50 GPa, about 10 to about 40 GPa, about 10 to about 30 GPa, about 20 to about 70 GPa, about 20 to about 60 GPa, about 20 to about 50 GPa, about 20 to about 40 GPa, about 20 to about 30 GPa, about 30 to about 70 GPa, about 30 to about 60 GPa, about 30 to about 50 GPa, about 30 to about 45 GPa, about 30 to about 40 GPa, about 30 to about 35 GPa, about 35 to about 70 GPa, about 35 to about 60 GPa, about 35 to about 50 GPa, about 35 to about 40 GPa, about 40 to about 70 GPa, about 40 to about 60 GPa, about 40 to about 50 GPa, about 45 to about 60 GPa or about 45 to about 50 GPa. In some instances, a composite material described herein has a hardness of about 30 to about 50 GPa, about 30 to about 45 GPa, about 30 to about 40 GPa, about 30 to about 35 GPa, about 35 to about 50 GPa, about 35 to about 40 GPa, about 40 to about 50 GPa or about 45 to about 50 GPa.

In some embodiments, a composite material described herein has a hardness of about 10 GPa, about 15 GPa, about 20 GPa, about 25 GPa, about 30 GPa, about 31 GPa, about 32 GPa, about 33 GPa, about 34 GPa, about 35 GPa, about 36 GPa, about 37 GPa, about 38 GPa, about 39 GPa, about 40 GPa, about 41 GPa, about 42 GPa, about 43 GPa, about 44 GPa, about 45 GPa, about 46 GPa, about 47 GPa, about 48 GPa, about 49 GPa, about 50 GPa, about 51 GPa, about 52 GPa, about 53 GPa, about 54 GPa, about 55 GPa, about 56 GPa, about 57 GPa, about 58 GPa, about 59 GPa, about 60 GPa or higher. In some embodiments, a composite material described herein has a hardness of about 10 GPa or higher. In some embodiments, a composite material described herein has a hardness of about 15 GPa or higher. In some embodiments, a composite material described herein has a hardness of about 20 GPa or higher. In some embodiments, a composite material described herein has a hardness of about 25 GPa or higher. In some embodiments, a composite material described herein has a hardness of about 30 GPa or higher. In some embodiments, a composite material described herein has a hardness of about 31 GPa or higher. In some embodiments, a composite material described herein has a hardness of about 32 GPa or higher. In some embodiments, a composite material described herein has a hardness of about 33 GPa or higher. In some embodiments, a composite material described herein has a hardness of about 34 GPa or higher. In some embodiments, a composite material described herein has a hardness of about 35 GPa or higher. In some embodiments, a composite material described herein has a hardness of about 36 GPa or higher. In some embodiments, a composite material described herein has a hardness of about 37 GPa or higher. In some embodiments, a composite material described herein has a hardness of about 38 GPa or higher. In some embodiments, a composite material described herein has a hardness of about 39 GPa or higher. In some embodiments, a composite material described herein has a hardness of about 40 GPa or higher. In some embodiments, a composite material described herein has a hardness of about 41 GPa or higher. In some embodiments, a composite material described herein has a hardness of about 42 GPa or higher. In some embodiments, a composite material described herein has a hardness of about 43 GPa or higher. In some embodiments, a composite material described herein has a hardness of about 44 GPa or higher. In some embodiments, a composite material described herein has a hardness of about 45 GPa or higher. In some embodiments, a composite material described herein has a hardness of about 46 GPa or higher. In some embodiments, a composite material described herein has a hardness of about 47 GPa or higher. In some embodiments, a composite material described herein has a hardness of about 48 GPa or higher. In some embodiments, a composite material described herein has a hardness of about 49 GPa or higher. In some embodiments, a composite material described herein has a hardness of about 50 GPa or higher. In some embodiments, a composite material described herein has a hardness of about 51 GPa or higher. In some embodiments, a composite material described herein has a hardness of about 52 GPa or higher. In some embodiments, a composite material described herein has a hardness of about 53 GPa or higher. In some embodiments, a composite material described herein has a hardness of about 54 GPa or higher. In some embodiments, a composite material described herein has a hardness of about 55 GPa or higher. In some embodiments, a composite material described herein has a hardness of about 56 GPa or higher. In some embodiments, a composite material described herein has a hardness of about 57 GPa or higher. In some embodiments, a composite material described herein has a hardness of about 58 GPa or higher. In some embodiments, a composite material described herein has a hardness of about 59 GPa or higher. In some embodiments, a composite material described herein has a hardness of about 60 GPa or higher.

In some embodiments, a composite material described herein has a bulk modulus of about 330 GPa to about 350 GPa.

In some embodiments, a composite material described herein has a grain size of about 20 μm or less. In some instances, the composite material has a grain size of about 15 μm or less, about 12 μm or less, about 10 μm or less, about 8 μm or less, about 5 μm or less, about 2 μm or less or about 1 μm or less. In some cases, the composite material has a grain size of about 15 μm or less. In some cases, the composite material has a grain size of about 12 μm or less. In some cases, the composite material has a grain size of about 10 μm or less. In some cases, the composite material has a grain size of about 9 μm or less. In some cases, the composite material has a grain size of about 8 μm or less. In some cases, the composite material has a grain size of about 7 μm or less. In some cases, the composite material has a grain size of about 6 μm or less. In some cases, the composite material has a grain size of about 5 μm or less. In some cases, the composite material has a grain size of about 4 μm or less. In some cases, the composite material has a grain size of about 3 μm or less. In some cases, the composite material has a grain size of about 2 μm or less. In some cases, the composite material has a grain size of about 1 μm or less.

In some instances, the grain size is an averaged grain size. In some cases, a composite material described herein has an averaged grain size of about 20 μm or less. In some instances, the composite material has an averaged grain size of about 15 μm or less, about 12 μm or less, about 10 μm or less, about 8 μm or less, about 5 μm or less, about 2 μm or less or about 1 μm or less. In some cases, the composite material has an averaged grain size of about 15 μm or less. In some cases, the composite material has an averaged grain size of about 12 μm or less. In some cases, the composite material has an averaged grain size of about 10 μm or less. In some cases, the composite material has an averaged grain size of about 9 μm or less. In some cases, the composite material has an averaged grain size of about 8 μm or less. In some cases, the composite material has an averaged grain size of about 7 μm or less. In some cases, the composite material has an averaged grain size of about 6 μm or less. In some cases, the composite material has an averaged grain size of about 5 μm or less. In some cases, the composite material has an averaged grain size of about 4 μm or less. In some cases, the composite material has an averaged grain size of about 3 μm or less. In some cases, the composite material has an averaged grain size of about 2 μm or less. In some cases, the composite material has an averaged grain size of about 1 μm or less.

In some embodiments, a composite material described herein is a densified composite material. In some instances, the densified composite material comprises a tungsten-based compound of the first formula $(W_{1-x}M_xX_y)_n$ and compound of the second formula $(M'X')_q$, $(M'X'_2)_q$, $(M'X'_4)_q$, $(M'X'_6)_q$, or $(M'X'_{12})_q$, or a combination thereof. In some instances, the densified composite material comprises a tungsten-based compound of the first formula $(W_{1-x}M_xB_4)_n$ and compound of the second formula $(M'X')_q$, $(M'X'_2)_q$, $(M'X'_4)_q$, $(M'X'_6)_q$, or $(M'X'_{12})_q$, or a combination thereof. In some instances, the densified composite material comprises a tungsten-based compound of the first formula $WB_4$, and compound of the second formula $(M'X')_q$, $(M'X'_2)_q$, $(M'X'_4)_q$, $(M'X'_6)_q$, or $(M'X'_{12})_q$, or a combination thereof.

Also described herein, in certain embodiments, is a tool comprising a surface or body for cutting or abrading, said surface or body being at least a surface of a hard material, wherein said hard material comprises two compositions:

(a) the composition comprising a first formula $(W_{1-x}M_xX_y)_n$,
wherein:
W is tungsten (W);
X is one of boron (B), beryllium (Be) and silicon (Si);
M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y) and aluminum (Al);
x is from 0.001 to 0.999;
y is at least 2.0;
n is from 0.001 to 0.999; and (b) the composition comprising a second formula $(M'X')_q$, $(M'X'_2)_q$, $(M'X'_4)_q$, $(M'X'_6)_q$, or $(M'X'_{12})_q$, or a combination thereof,
wherein:
X' is one of B, Be, and Si,
M is at least one of Hf, Zr, and Y;
q is from 0.001 to 0.999; and
wherein the sum of q and n is 1; and
wherein the second composition (b) encompasses the edges, in part or in whole, of the first composition, acting as a protective coating.

Tungsten Tetraboride

Some embodiments of the current subject matter are related to the hardness improvement of tungsten tetraboride ($WB_4$) by substituting various concentrations (partial or complete) of tungsten and/or boron with transition metals and light elements, respectively. The increase of hardness, due to solid solution, grain boundary dispersion and precipitation hardening mechanisms lead to the production of machine tools with enhanced life time according to some embodiments of current subject matter. In some embodiments, the developed materials, both in bulk and thin film conditions, are used in a variety of applications including drill bits, saw blades, lathe inserts and extrusion dies as well as punches for cup, tube and wire drawing processes according to some embodiments of the current subject matter.

The existing state-of-the-art in the area of transition metal-borides includes the solid-state synthesis and characterization of osmium and ruthenium diboride compounds, rhenium diboride and tungsten diboride. The concept of high hardness of tungsten tetraboride ($WB_4$) was first introduced, which contains more boron-boron bonds compared to aforementioned superhard diborides, and its application as a superhard material was discussed.

Tungsten Tetraboride with Transition Metals and Light Elements

Described are new superhard materials based on tungsten tetraboride by replacing tungsten with other transition metals such as rhenium according to some embodiments of the current subject matter. In addition to being inexpensive and possessing metallic conductivity, the developed materials exhibit improved Vickers hardness to well above 50 GPa, which is by far higher than the hardness of $WB_4$ (about 43 GPa).

Compositional variations of $WB_4$ are synthesized by replacing W with other metals (such as Ti, V, Cr, Mn, Fe, Co, Ni, Cu, Zn, Zr, Nb, Mo, Ru, Hf, Ta, Re, Os, Ir, Li, Sc, Y, and Al) and/or B with light elements (such as Be and Si) according to some embodiments of the current subject matter. Pure powders of these elements, with a desired stoichiometry, are ground together using an agate mortar and pestle until a uniform mixture is achieved. In the case of $WB_4$ compounds, a tungsten to boron ratio of 1:12 should be used. The excess boron is needed to compensate for its evaporation during synthesis and to ensure the thermodynamic stability of the $WB_4$ structure based on the binary phase diagram of the tungsten-boron system. Each mixture is pressed into a pellet by means of a hydraulic (bottlejack) press. The pellets are then placed in an arc melting furnace and an AC/DC current of >60 Amps is applied under high-purity argon at ambient pressure. In some other embodiments, other synthesis techniques including hot press and spark plasma sintering are used. To make thin films of these materials, various deposition techniques such as sputtering, pack cementation, etc. are used.

The implementation of these compounds in practice requires some minor technical adjustments and their adaptation to industrial scale. For example, using powerful presses to press big pellets and big arc melting furnaces to arc large pellets is needed for some applications. In the case of using sintering methods to synthesize the specimens, appropriate large-scale hot press or SPS machines and well-designed dies for the specific geometries of the products (inserts, drill bits, dies, etc.) may be required. Since most of these compounds are electrically conductive, to minimize the production time electro discharge machines (EDMs) is also very beneficial for cutting, drilling, finishing and other post-synthesis processes necessary for the fabrication of the products made of these superhard materials according to some embodiments of the current subject matter. To add ductility to the products, adding Co, Ni, or Cu or a combination of these three elements is useful. In some embodiments, for thin film applications of these materials, hi-tech thin film deposition systems are needed.

In some embodiments, described herein are successfully synthesized and characterized various concentrations of Re in $WB_4$, i.e. $W_{1-x}Re_xB_4$ (x=0.005-0.5). The experiments show that substitution of 1 wt. % W with Re increases the Vickers hardness of $WB_4$ from about 43 GPa to about 50 GPa under an applied load of 0.49 N. This compound is thermally stable in air up to 400° C. Also described herein are synthesized various stoichiometries of $WB_4$ with Ta, Mo, Mn and Cr, the observed hardness results of some of the compounds of which are well above 50 GPa. For example, it has been measured that Vickers hardness values (under an applied load of 0.49 N) of 52.8, 53.7 and 53.5 GPa when about 2.0, 4.0 and 10.0 wt. % of W in $WB_4$ are replaced with Ta, Mn and Cr, respectively. Also, by taking advantage of these results, described herein are synthesized ternary/quaternary solid solutions of $WB_4$ with combinations of these three elements by keeping the concentration of Ta in $WB_4$ fixed wt 2.0 wt. % while varying those of Mn and Cr from 2.0 to 10.0 wt. %. This led to hardness (at 0.49 N) values as high as 55.8 and 57.3 GPa for the combinations $W_{0.94}Ta_{0.02}Mn_{0.04}B_4$ and $W_{0.93}Ta_{0.02}Cr_{0.05}B_4$, respectively. It is demonstrated that $WB_4$ is easily cut using an EDM machine, due to its superior electrical conductivity. The cut sample by EDM is used to test the machining performance of the compositional materials. The ductility of these compounds is improved by adding Co, Ni or Cu to them.

Tools according to some embodiments of the current subject matter has at least a cutting or abrading surface made from any of the compositions according to embodiments of the current subject matter. In some embodiments, a tool has a film or coating of the above-noted compositions according to embodiments of the current subject matter. In other embodiments, a tool is made from and/or include a component made from the above-noted compositions according to embodiments of the current subject matter. In some embodiments, drill bits, blades, dies, etc. is either coated or made from the above-noted materials according to embodiments of the current subject matter. However, tools and tool components are not limited to these examples. In other embodiments, a powder or granular form of the above-noted materials is provided either alone or attached to a backing structure to provide an abrading function. In some embodiments, the compositions according to the current subject matter are used in applications to replace currently used hard materials, such as tungsten carbide. In some embodiments, the above-noted materials are used as a protective surface coating to provide wear resistance and resistance to abrasion or other damage.

Binder Composition of Tungsten Tetraboride with Transition Metals and Light Elements In some embodiments, described herein is a composite material provided as a combination of the variations of $WB_4$ with transition metals and light elements (a $W_{1-x}M_xX_y$ composition) and a binder, such as a group 4, 5, 6, 7, 8, 9, 10, 11, 12, 13, or 14 transition metal element in the Periodic Table of Elements. In some embodiments, described herein is a composite material provided as a combination of the variations of $WB_4$ with transition metals and light elements (a $W_{1-x}M_xX_y$ composition) and a binder, such as a group 8, 9 or 10 transition metal element in the Periodic Table of Elements. In further embodiments, the binder comprises at least one of elements from Fe, Co, and Ni, wherein the wt. % range for the binder is from 0.001 to 0.5. In some further embodiments, the wt. % range for the binder is from 0.01 to 0.5. In some further embodiments, the wt. % range for the binder is from 0.1 to 0.5.

In some embodiments, the composite material comprises 90 wt. % of $W_{1-x}M_xX_y$, with transition metals and light elements 10 wt. % of Co metal as a binder. In some further embodiments, the composite material comprises from about 73 wt. % to about 95 wt. % of $W_{1-x}M_xX_y$, and about 5 wt. % to about 27 wt. % of a solid solution Co—Ni—Fe binder, comprising from about 40 wt. % to about 90 wt. % Co, from about 4 wt. % to about 36 wt. % Ni, and from about 4 wt. % to about 36 wt. % Fe, and wherein a Ni:Fe ratio is from about 1.5:1 to about 1:1.5, and wherein the solid solution of the binder exhibits substantially no stress and strain induced phase transformations.

In some embodiments, by way of non-limiting examples, the $W_{1-x}M_xX_y$ composition is grounded to a fine powder (e.g. 1-30 μm) and thoroughly mixed with a fine powder of the binder, and then a densification is occurred to make it into a fully densified composite material. In some embodiments, by way of non-limiting examples, the $W_{1-x}M_xX_y$ composition is grounded to a fine powder (e.g. 1-10 μm) and thoroughly mixed with a fine powder of the binder, and then a densification is occurred to make it into a fully densified composite material.

In some embodiments, by way of non-limiting examples, predetermined composition of $W_{1-x}M_xX_y$ to binder, having been mixed, is loaded into a die of the desired geometry, and pressed under a force (e.g. 20 tons), to produce a "green pellet", which is then sintered in a high temperature vacuum furnace (e.g. 1400° C.), for some time (e.g. 1-6 hours). The final product is a fully densified $WB_4$ composite with binder. In other embodiments, by way of non-limiting examples, the predetermined composition of $W_{1-x}M_xX_y$ to binder, having been mixed, are loaded into a graphite die to undergo a hydraulic compaction, and are then loaded into a Spark Plasma Sintering furnace (SPS) or a high-temperature high-pressure furnace (HTHP) or a hot-isostatic press (HIP), to be subjected to a pressure process and a temperature sweep either simultaneously or sequentially, thereby producing a fully densified $WB_4$ composite with binder.

In some instances, the toughness of these finished materials is higher relative to a compound with a formula of $W_{1-x}M_xX_y$, at a sacrifice in hardness, but exhibits properties readily demanded in an application environment (such that "pure" $W_{1-x}M_xX_y$ alone would not handle, i.e. machining).

Tools according to some embodiments of the current subject matter have at least a cutting or abrading surface made from any of the composite materials with predetermined composition of $W_{1-x}M_xX_y$ to binder according to embodiments of the current subject matter. In some embodiments, a tool has a film or coating of the above-noted composite materials according to embodiments of the current subject matter. In other embodiments, a tool is made from and/or include a component made from the above-noted composite materials according to embodiments of the current subject matter. In some embodiments, drill bits, blades, dies, etc. are either coated or made from the above-noted materials according to embodiments of the current subject matter. However, tools and tool components are not limited to these examples. In other embodiments, a powder or granular form of the above-noted materials are provided either alone or attached to a backing structure to provide an abrading function. In some embodiments, the compositions according to the current subject matter In some embodiments used in applications to replace currently used hard materials, such as tungsten carbide, for example. In some embodiments, the above-noted materials are used as a protective surface coating to provide wear resistance and resistance to abrasion or other damage, for example.

Tungsten Tetraboride with Transition Metals and Light Elements with Protective Coating In some embodiments, the formulation of $W_{1-x}M_xX_y$ where W is tungsten (W); X is one of the boron (B), beryllium (Be) and silicon (Si); and M is Hf, Zr, or Y, or a combination thereof. In this formulation M forms compositions of the formula M'X', $M'X'_2$, $M'X'_4$, $M'X'_6$, or $M'X'_{12}$, or a combination thereof, and encompasses the edges, in part or in whole, of the $W_{1-x}M_xX_y$ composition, acting as a protective coating. In formulation $W_{1-x}M_xX_y$, x in the final product is at least 0.001 and less than 0.50 composition. In some embodiments, by way of non-limiting examples, with the addition of an excess of Hf, Zr, or Y, or a combination thereof (nominal, pre-synthesis formulation where x is between 0.50 to 1.5, such that the formulation is $W_{0.9}M_{1.5}B_4$, before arc-melting), results in a post-synthesis composition of $W_{1-x}M_xX_y+MX_2$ at the grain boundaries. So essentially, it is a $WB_4$ (with the solid-solution additives), with a secondary phase encompassing the edges, in part or in whole. In some cases, the intentional secondary phase surrounding the $WB_4$ is for an increased oxidation resistance relative to a compound that does not have the secondary phase. In some cases, the secondary phase protects the underlying $WB_4$ from oxidation. In some embodiments, by way of non-limiting examples, the interest is in covering any high oxidation point diboride ($MB_2$), where M is at least one of Hf, Zr, and Y, as a composite/binary composition ($WB_4$ with an $MB_2$ at grain boundaries). These two species would be intimately interspersed and inseparable.

Tools according to some embodiments of the present subject matter have at least a cutting or abrading surface made from any of the composite materials with predetermined composition of $W_{1-x}M_xX_y$ to a protective $MB_2$ containing coating according to embodiments of the present subject matter. In some embodiments, a tool has a film or coating of the above-noted composite materials according to embodiments of the current subject matter. In other embodiments, a tool is made from and/or is designed to include a component made from the above-noted composite materials according to embodiments of the current subject matter. In some embodiments, drill bits, blades, dies, etc. are either coated or made from the above-noted materials according to embodiments of the current subject matter. However, tools and tool components are not limited to these examples. In other embodiments, a powder or granular form of the above-noted materials are provided either alone or attached to a backing structure to provide an abrading function. In some embodiments, the compositions according to the current subject matter are used in applications to replace currently used hard materials, such as tungsten carbide, for example. In some embodiments, the above-noted materials are used as a protective surface coating to provide wear resistance and resistance to abrasion or other damage, for example.

Methods of Manufacture

In certain embodiments, described herein include methods of making a composite material. In some embodiments, described herein comprises a method of preparing an oxidative resistant composite material, which comprises (a) blending together a composition having a first formula $(W_{1-x}M_xX_y)_n$, and a composition having a second formula $T_q$ for a time sufficient to produce a powder mixture; wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; q and n are each independently from 0.001 to 0.999; and the sum of q and n is 1; (b) pressing the powder mixture under a pressure sufficient to generate a pellet; and (c) sintering the pellet at a temperature sufficient to produce a densified composite material.

In some embodiments, described herein comprises a method of preparing a densified composite material, which comprises (a) blending together a first composition having a formula $(W_{1-x}M_xB_4)_n$ and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; q and n are each independently from 0.001 to 0.999; and the sum of q and n is 1; (b) pressing the powder mixture under a pressure sufficient to generate a pellet; and (c) sintering the pellet at a temperature sufficient to produce a densified composite material.

In some embodiments, described herein comprises a method of preparing a densified composite material, which comprises (a) blending together a first composition having a formula $(WB_4)_n$ and a second composition of formula $T_q$ for a time sufficient to produce a powder mixture; wherein: T is an alloy comprising at least one Group 4, 5, 6, 7, 8, 9, 10, 11, 12, 13, or 14 element in the Periodic Table of Elements; q and n are each independently from 0.001 to 0.999; and the sum of q and n is 1; (b) pressing the powder mixture under a pressure sufficient to generate a pellet; and (c) sintering the pellet at a temperature sufficient to produce a densified composite material.

In some embodiments, described herein comprises a method of preparing a densified composite material, which comprises (a) blending together a first composition having a formula $(W_{1-x}M_xBe_y)_n$, and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; q and n are each independently from 0.001 to 0.999; and the sum of q and n is 1; (b) pressing the powder mixture under a pressure sufficient to generate a pellet; and (c) sintering the pellet at a temperature sufficient to produce a densified composite material.

In some embodiments, described herein comprises a method of preparing a densified composite material, which comprises (a) blending together a first composition having a formula $(W_{1-x}M_xSi_y)_n$ and a second composition of formula $T_q$ for a time sufficient to produce a powder mixture; wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); T is an alloy comprising at least one Group 4, 5, 6, 7, 8, 9, 10, 11, 12, 13, or 14 element in the Periodic Table of Elements; x is from 0.001 to 0.999; y is at least 4.0; q and n are each independently from 0.001 to 0.999; and the sum of q and n is 1; (b) pressing the powder mixture under a pressure sufficient to generate a pellet; and (c) sintering the pellet at a temperature sufficient to produce a densified composite material.

In some embodiments, the blending time is about 5 minutes to about 6 hours. In some instances, the blending time is about 5 minutes, about 10 minutes, about 15 minutes, about 20 minutes, about 30 minutes, about 45 minutes, about 1 hour, about 1.5 hour, about 2 hours, about 3 hours, about 4 hours, about 5 hours or about 6 hours.

In some embodiments, the blending time is at least 5 minutes or more. In some cases, the blending time is about 10 minutes or more. In some cases, the blending time is about 20 minutes or more. In some cases, the blending time is about 30 minutes or more. In some cases, the blending time is about 45 minutes or more. In some cases, the blending time is about 1 hour or more. In some cases, the blending time is about 2 hours or more. In some cases, the blending time is about 3 hours or more. In some cases, the blending time is about 4 hours or more. In some cases, the blending time is about 5 hours or more. In some cases, the blending time is about 6 hours or more. In some cases, the blending time is about 8 hours or more. In some cases, the blending time is about 10 hours or more. In some cases, the blending time is about 12 hours or more.

In some instances, a pressure of up to 36,000 psi is utilized to generate a pellet. In some instances, the pressure is up to 34,000 psi. In some instances, the pressure is up to 32,000 psi. In some instances, the pressure is up to 30,000 psi. In some instances, the pressure is up to 28,000 psi. In some instances, the pressure is up to 26,000 psi. In some instances, the pressure is up to 24,000 psi. In some instances, the pressure is up to 22,000 psi. In some instances, the pressure is up to 20,000 psi. In some instances, the pressure is up to 18,000 psi. In some instances, the pressure is up to 16,000 psi. In some instances, the pressure is up to 15,000 psi. In some instances, the pressure is up to 14,000 psi. In some instances, the pressure is up to 10,000 psi.

In some embodiments, a method described herein further comprises a sintering step. In some instances, the sintering step generates a densified composite material. In some instances, the sintering step is carried out at elevated temperatures. In some cases, the temperature during sintering is from 1000° C. to 2000° C. In some cases, the temperature during sintering is from 1000° C. to 1900° C. In some cases, the temperature during sintering is from 1200° C. to 1900° C. In some cases, the temperature during sintering is from 1300° C. to 1900° C. In some cases, the temperature during sintering is from 1400° C. to 1900° C. In some cases, the temperature during sintering is from 1000° C. to 1800° C. In some cases, the temperature during sintering is from 1000° C. to 1700° C. In some cases, the temperature during sintering is from 1200° C. to 1800° C. In some cases, the temperature during sintering is from 1300° C. to 1700° C. In some cases, the temperature during sintering is from 1000° C. to 1600° C. In some cases, the temperature during sintering is from 1500° C. to 1800° C. In some cases, the temperature during sintering is from 1500° C. to 1700° C. In some cases, the temperature during sintering is from 1500° C. to 1600° C. In some cases, the temperature during sintering is from 1600° C. to 2000° C. In some cases, the temperature during sintering is from 1600° C. to 1900° C. In some cases, the temperature during sintering is from 1600° C. to 1800° C. In some cases, the temperature during sintering is from 1600° C. to 1700° C. In some cases, the temperature during sintering is from 1700° C. to 2000° C. In some cases, the temperature during sintering is from 1700° C. to 1900° C. In some cases, the temperature during sintering is from 1700° C. to 1800° C. In some cases, the temperature during sintering is from 1800° C. to 2000° C. In some cases, the temperature during sintering is from 1800° C. to 1900° C. In some cases, the temperature during sintering is from 1900° C. to 2000° C.

In some cases, the temperature is about 1000° C., about 1100° C., about 1200° C., about 1300° C., about 1400° C., about 1500° C., about 1600° C., about 1700° C., about 1800° C., about 1900° C. or about 2000° C. In some cases, the temperature is about 1000° C. In some cases, the temperature is about 1100° C. In some cases, the temperature is about 1200° C. In some cases, the temperature is about 1300° C. In some cases, the temperature is about 1400° C. In some cases, the temperature is about 1500° C. In some cases, the temperature is about 1600° C. In some cases, the temperature is about 1700° C. In some cases, the temperature is about 1800° C. In some cases, the temperature is about 1900° C. In some cases, the temperature is about 2000° C.

In some cases, sintering is carried out at room temperature.

In some embodiment, a sintering step described herein involves an elevated temperature and an elevated pressure, e.g., hot pressing. Hot pressing is a process involving a simultaneous application of pressure and high temperature, which can accelerate the rate of densification of a material (e.g., a composite material described herein). In some instances, a temperature from 1000° C. to 2000° C. and a pressure of up to 36,000 psi are used during hot pressing.

In other embodiments, a sintering step described herein involves an elevated pressure and room temperature, e.g., cold pressing. In such instances, pressure of up to 36,000 psi is used.

Tools and Abrasive Materials

In some embodiments, a composite material described herein are used to make, modify, or coat a tool or an abrasive material. In some instances, a composite material described herein is coated onto the surface of a tool or an abrasive material. In other instances, the surface of a tool or an abrasive material is modified with a composite material described herein. In additional instances, the surface of a tool or abrasive material comprises a composite material described herein.

In some embodiments, a tool or abrasive material comprises a cutting tool. In some instances, a tool or abrasive material comprises a tool or a component of a tool for cutting, drilling, etching, engraving, grinding, carving or polishing. In some instances, a tool or abrasive material comprises a metal bond abrasive tool, for example, such as a metal bond abrasive wheel or grinding wheel. In some instances, a tool or abrasive material comprises drilling tools. In some instances, a tool or abrasive material comprises drill bits, inserts or dies. In some cases, a tool or abrasive material comprises tools or components used in downhole tooling. In some cases, a tool or abrasive material comprises an etching tool. In some cases, a tool or abrasive material comprises an engraving tool. In some cases, a tool or abrasive material comprises a grinding tool. In some cases, a tool or abrasive material comprises a carving tool. In some cases, a tool or abrasive material comprises a polishing tool.

In some embodiment, a surface of a tool or abrasive material comprises a composite material described herein. In some cases, a surface of a tool or abrasive material comprises a composite material which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material comprises a composite material which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material comprises a composite material which comprises (a) a tungsten tetraboride of formula $(WB_4)_n$, wherein n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material comprises a composite material which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material comprises a composite material which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, the tool or abrasive material comprises a tool or a component of a tool for cutting, drilling, etching, engraving, grinding, carving or polishing. In some cases, the composite material inhibits oxidation from forming on the tool or abrasive material. In other cases, the composite material reduces the rate of oxidation formed on the tool or abrasive material relative to a tool or abrasive material that does not contain the composite material.

In some embodiment, a surface of a tool or abrasive material is modified with a composite material described herein. In some cases, a surface of a tool or abrasive material is modified with a composite material which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is modified with a composite material which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is modified with a composite material which comprises (a) a tungsten tetraboride of formula $(WB_4)_n$, wherein n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is modified with a composite material which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is modified with a composite material which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, the tool or abrasive material comprises a tool or a component of a tool for cutting, drilling, etching, engraving, grinding, carving or polishing. In some cases, the composite material inhibits oxidation from forming on the tool or abrasive material. In other cases, the composite material reduces the rate of oxidation formed on the tool or abrasive material relative to a tool or abrasive material that does not contain the composite material.

In some embodiment, a surface of a tool or abrasive material is coated with a composite material described herein. In some cases, a surface of a tool or abrasive material is coated with a composite material which comprises (a) a first formula $(W_{1-x}M_xX_y)_n$, wherein: X is one of B, Be and Si; M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is coated with a composite material which comprises (a) a first formula $(W_{1-x}M_xB_4)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is coated with a composite material which comprises (a) a tungsten tetraboride of formula $(WB_4)_n$, wherein n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is coated with a composite material which comprises (a) a first formula $(W_{1-x}M_xBe_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, a surface of a tool or abrasive material is coated with a composite material which comprises (a) a first formula $(W_{1-x}M_xSi_y)_n$, wherein: M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), yttrium (Y) and aluminum (Al); x is from 0.001 to 0.999; y is at least 4.0; and n is from 0.001 to 0.999; and (b) a second formula $T_q$; wherein: T is an alloy comprising at least one Group 4, 5, 6, 7, 8, 9, 10, 11, 12, 13, or 14 element in the Periodic Table of Elements; and q is from 0.001 to 0.999; and wherein the sum of q and n is 1. In some cases, the tool or abrasive material comprises a tool or a component of a tool for cutting, drilling, etching, engraving, grinding, carving or polishing. In some cases, the composite material inhibits oxidation from forming on the tool or abrasive material. In other cases, the composite material reduces the rate of oxidation formed on the tool or abrasive material relative to a tool or abrasive material that does not contain the composite material.

Certain Terminologies

Unless defined otherwise, all technical and scientific terms used herein have the same meaning as is commonly understood by one of skill in the art to which the claimed subject matter belongs. It is to be understood that the detailed description are exemplary and explanatory only and are not restrictive of any subject matter claimed. In this application, the use of the singular includes the plural unless specifically stated otherwise. It must be noted that, as used in the specification, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

Group 4 metals of the Periodic Table of Elements (may also refer as group IVB or 4B) include titanium (Ti), zirconium (Zr), and hafnium (Hf).

Group 5 metals of the Periodic Table of Elements (may also refer as group VB or 5B) include vanadium (V), niobium (Nb), and tantalum (Ta).

Group 6 metals of the Periodic Table of Elements (may also refer as group VIB or 6B) include chromium (Cr), molybdenum (Mo), and tungsten (W).

Group 7 metals of the Periodic Table of Elements (may also refer as group VIIB or 7B) include manganese (Mn) and rhenium (Re).

Group 8 metals of the Periodic Table of Elements (may also refer as group VIII or 8) include iron (Fe), ruthenium (Ru), and osmium (Os).

Group 9 metals of the Periodic Table of Elements (may also refer as group VIII or 8) include cobalt (Co), rhodium (Rh), and iridium (Ir).

Group 10 metals of the Periodic Table of Elements (may also refer as group VIII or 8) include nickel (Ni), palladium (Pd), and platinum (Pt).

Group 11 metals of the Periodic Table of Elements (may also refer as group IB or 1B) include copper (Cu), silver (Ag), and gold (Au).

Group 12 metals of the Periodic Table of Elements (may also refer as group JIB or 2B) include zinc (Zn) and cadmium (Cd)

Group 13 metals of the Periodic Table of Elements (may also refer as group IIIA or 3A) include aluminum (Al), gallium (Ga), and indium (In).

Group 14 metals of the Periodic Table of Elements (may also refer as group IVA or 4A) include silicon (Si), germanium (Sn), and tin (Sn).

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

As used herein, ranges and amounts can be expressed as "about" a particular value or range. About also includes the exact amount. Hence "about 5 GPa" means "about 5 GPa" and also "5 GPa." Generally, the term "about" includes an amount that would be expected to be within experimental error, e.g., ±5%, ±10% or ±15%. In some cases, "about" includes ±5%. In other cases, "about" includes ±10%. In additional cases, "about" includes ±15%.

The section headings used herein are for organizational purposes only and are not to be construed as limiting the subject matter described.

EXAMPLES

These examples are provided for illustrative purposes only and not to limit the scope of the claims provided herein.

Example 1. Synthesis of Illustrative Composite Materials

TABLE 1

Compositions of Illustrative Composite Materials.

| Composition | $(W_{1-x}M_xX_y)_n$ | wt % | $T_q$ | wt % |
|---|---|---|---|---|
| A | $WB_4$ | 85 | Ni | 15 |
| B | $WB_4$ | 30 | Ni | 70 |
| C | $WB_4$ | 30 | Cu | 70 |
| D | $WB_4$ | 22 | Co, Cu, Sn, W, Ni | 78 |

Compositions A-C are $WB_4$ with a single metal (from Group 4-14) binder.

Composition D is $WB_4$ with a binder alloy containing approximately 50 wt. % Cu, 15 wt. % W, 20 wt. % Co, 5 wt. % Sn, 10 wt. % Ni; the binder alloy comprises 70 wt. % of the sample, with the balance being $WB_4$.

The following protocol can be applied to each of the composite material listed above. The tungsten-based metal composition $W_{1-x}M_xX_y$, and T are mixed using an agate mortar and pestle until a uniform mixture is achieved. The powder mixture is then subjected under pressure of up to 32,000 psi to generate a pellet. The pellet is subjected to a sintering step to generate the composite material. In brief, the temperature is raised at a rate of about 45° C./min to 2000° C. and held constant for about 3 minutes. Then, the temperature is lowered within 5 minutes to below 1000° C.

Example 2. Example of Hardmetal/Binder Composite

The composite material comprises from about 73 wt. % to about 95 wt. % of $WB_4$, and about 5 wt. % to about 27 wt. % of a solid solution Co—Ni—Fe binder, comprising from about 40 wt. % to about 90 wt. % Co, from about 4 wt. % to about 36 wt. % Ni, and from about 4 wt. % to about 36 wt. % Fe, and wherein a Ni:Fe ratio is from about 1.5:1 to about 1:1.5, and wherein the solid solution of the binder exhibits substantially no stress and strain induced phase transformations.

The $WB_4$ is ground to a fine powder (e.g. 1-30 μm) and thoroughly mixed with a fine powder of the solid solution Co—Ni—Fe binder, and then a densification is occurred to make it into a fully densified composite material.

Example 3. Microindentation

The following is microindentation data from composite samples. These samples comprise binary systems, such that it is $WB_4$+one Group 4-14 metal, or $WB_4$+an alloy comprising group 4-14 metals. The loading used was in kgf, kilogram-force, correlated to Hv which is Vickers Hardness. The standard loading(s) used for Vickers Hardness microindentation was either 1 kgf or 30 kgf. When the loading was 1 kgf, it was denoted as $Hv_1$, or in the case of 30 kgf, it was denoted as $Hv_{30}$. The grain size listed corresponds to $WB_4$ and is a median particle size used for the sample. The binder phase was equal to or less than 3 micron.

TABLE 2

Microindentation Data from Composite Samples.

| Composition | Load (kgf) | Avg. $WB_4$ Grain Size (μm) | Min. (GPa) | Avg. (GPa) | Max. (GPa) |
|---|---|---|---|---|---|
| A | 1 | 10 | 22.65 | 28.48 ± 3.74 | 38.12 |
| A | 30 | 10 | 17.93 | 26.33 ± 4.58 | 36.32 |
| B | 1 | 10 | 17.45 | 25.66 ± 3.31 | 32.48 |
| C | 1 | 400 | 14.53 | 22.77 ± 4.73 | 27.33 |
| D | 1 | 400 | — | 18 | — |

Compositions A-C are $WB_4$ with a single metal (from Group 4-14) binder.

Composition D is $WB_4$ with a binder alloy containing approximately 50 wt. % Cu, 15 wt. % W, 20 wt. % Co, 5 wt. % Sn, 10 wt. % Ni; the binder alloy comprises 70 wt. % of the sample, with the balance being $WB_4$.

Prior to sintering, the components of the system were finely divided into powders. The $WB_4$ used in this experiment comprised a size range from about 1 μm to about 750 μm. Prior to sintering, the binders used comprised a size of 325 mesh (45 μm) or less. The particle size of the hard material did not change post-sintering, but the binder or binder alloy had a uniformly dense metallic phase.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A tool or tool component, wherein the tool or tool component comprises a composite material, wherein the composite comprises:

(a) a first composition comprising a first formula $(W_{1-x}M_xX_y)_n$, wherein:

W is tungsten (W);

X is one of boron (B), beryllium (Be) and silicon (Si);

M is at least one of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), ruthenium (Ru), hafnium (Hf), tantalum (Ta), rhenium (Re), osmium (Os), iridium (Ir), lithium (Li), scandium (Sc), yttrium (Y), and aluminum (Al);

x is from 0 to 0.999;

y is at least 4.0;

n is from 50% to 99.9% by weight; and (b) a second composition comprising a second formula $T_q$, wherein:

T comprises an alloy which is a combination of four or more group 4, 5, 6, 7, 8, 9, 10, 11, 12, 13, and 14 transition metal elements in the Periodic Table of Elements;

q is from 0.1% to 50% by weight;

the sum of q and n is 100% by weight; and wherein the composite material has an average Vicker's hardness of about 10 to about 30 GPa as measured under a force of 9.8 N (1 kgf).

2. The tool of claim 1, wherein the composite material is the body of the tool or tool component.

3. The tool of claim 1, wherein the composite material is a surface of the tool or tool component.

4. The tool of claim 1, wherein the composite material coats the tool or tool component.

5. The tool of claim 1, wherein the tool or tool component comprises a wheel or grinding wheel.

6. The tool of claim 1, wherein the tool or tool component comprises a drilling tool.

7. The tool of claim 1, wherein the tool or tool component comprises drill bits, inserts, or dies.

8. The tool of claim 1, wherein the tool or tool component comprises a downhole tool.

9. The tool of claim 1, wherein the tool or tool component comprises an etching tool.

10. The tool of claim 1, wherein the tool or tool component comprises an engraving tool or carving tool.

11. The tool of claim 1, wherein the tool or tool component comprises a grinding tool or polishing tool.

12. The tool of claim 1, wherein the $(W_{1-x}M_xX_y)_n$ has a median particle size of about 1 to about 750 μm.

13. The tool of claim 1, wherein the $T_q$ has a median particle size of about 45 μm or less.

14. The tool of claim 1, wherein X is B.

15. The tool of claim 1, wherein M comprises at least one of Re, Mn, Cr, Hf, Ta, Zr, and Y.

16. The tool of claim 1, wherein M comprises at least two of Ti, V, Cr, Mn, Fe, Co, Ni, Cu, Zn, Zr, Nb, Mo, Ru, Hf, Ta, Re, Os, Ir, Li, Sc, Y, and Al.

17. The tool of claim 1, wherein M comprises Re, Ta, Mn, or Cr.

18. The tool of claim 1, wherein x is from 0.001 to 0.4.

19. The tool of claim 1, wherein T comprises at least one of Co, Fe, Ni, and Sn.

20. The tool of claim 1, wherein the composite material is resistant to oxidation.

* * * * *